US005164780A

United States Patent [19]

Ohno et al.

[11] Patent Number: 5,164,780

[45] Date of Patent: Nov. 17, 1992

[54] IMAGE FORMING APPARATUS HAVING DEVELOPER CARRYING MEMBER WITH SURFACE LAYER OF DEFINED LOAD CURVE

[75] Inventors: Manabu Ohno, Funabashi; Yukari Ishibashi, Yokohama; Tetsuhito Kuwashima, Yokohama; Hiroyuki Suematsu, Yokohama, all of Japan

[73] Assignee: Canon Kabushiki Kaisha, Tokyo, Japan

[21] Appl. No.: 715,469

[22] Filed: Jun. 14, 1991

[30] Foreign Application Priority Data

| | | | |
|---|---|---|---|
| Jun. 15, 1990 | [JP] | Japan | 2-155115 |
| Jul. 13, 1990 | [JP] | Japan | 2-183900 |
| Oct. 12, 1990 | [JP] | Japan | 2-272133 |
| Oct. 12, 1990 | [JP] | Japan | 2-272134 |
| Nov. 22, 1990 | [JP] | Japan | 2-319505 |
| Nov. 22, 1990 | [JP] | Japan | 2-319506 |

[51] Int. Cl.[5] ..... G03G 15/09

[52] U.S. Cl. ..... 355/251; 430/102; 430/105

[58] Field of Search ..... 118/657, 658; 355/251, 355/253; 430/102, 105

[56] References Cited

U.S. PATENT DOCUMENTS 4,989,044 1/1991 Nishimura ..... 355/251

*Primary Examiner*—Benjamin R. Fuller
*Assistant Examiner*—Scott A. Rogers
*Attorney, Agent, or Firm*—Fitzpatrick, Cella, Harper & Scinto

[57] ABSTRACT

An image forming apparatus comprising an electrostatic latent image bearing member and a developing apparatus for developing an electrostatic latent image. The developing apparatus comprises a developer container in which a developer is held, and a developer-carrying member for carrying thereon the developer and transporting the developer to a developing zone. The developer-carrying member has a surface layer of a resin containing at least conductive fine particles and a solid lubricant, and the surface layer has in its relative load curve (Abbot's load curve) a cutting depth $C_v$ of not more than 5 μm when a relative load length $t_p$ is 5%; and the developer contains a toner and a fine powder pretreated with a silicone oil or silicone varnish.

126 Claims, 4 Drawing Sheets

IMAGE FORMING APPARATUS HAVING DEVELOPER CARRYING MEMBER WITH SURFACE LAYER OF DEFINED LOAD CURVE

BACKGROUND OF THE INVENTION

1. Field of the Invention

The present invention relates to an image forming apparatus provided with a developing apparatus containing a developer for developing an electrostatic latent image, that image forming apparatus is used for forming a latent image on an electrostatic latent image bearing member such as an electrophotographic photosensitive member or a static recording dielectric member and converting the latent image to a visible one. It also relates to an apparatus unit and a facsimile apparatus making use of such an apparatus.

2. Related Background Art

In recent years, uses of electrophotographic printers are being rapidly spread as computer output apparatus, and also spread as printers useful in office automation and as facsimile image reproducing apparatus. These printers are required to have a high print quality.

A laser-beam printer (LBP) that is prevailing in the printers using an electrophotographic system is an output apparatus by which the on-off of a semiconductor laser, corresponding with the output information from a computer, is written as a digital latent image onto a photosensitive drum through a rotating multifacer mirror, and an image is printed on a recording sheet by an electrostatographic process.

In an electrophotographic apparatus in which a latent image is comprised of fundamental picture elements (hereinafter "dots" as in the case of an LBP, the light output to a photosensitive member pertains to the formation of a digital latent image composed of an on-off binary, and hence the edge effect becomes predominant when the latent image is developed.

The edge effect is a phenomenon in which electric lines of force concentrate at the boundary between an exposed area and an unexposed area of a latent image to cause an apparent increase in surface potential of a photosensitive member, resulting in an increase in image density at the boundary. It has been hitherto considered that this phenomenon is undesirable and should be avoided, since it brings about a non-uniformity in a solid image (i.e, an increase in image density at edges).

On the other hand, in image forming methods in which a latent image is composed of picture elements of 50 μm to 150 μm in size, the part affected by the edge effect is larger than that of usual analog images, and hence the edge effects are positively utilized to obtain a developed image with a good line reproduction and a high image density.

As a special tendency in the development of edge portions, a gradient of charge quantity is produced corresponding with a gradient of potential, unless the charge quantity of a developer is sufficiently high. Therefore, toner particles with a large charge quantity are selectively used in preference, and toner particles with a small charge quantity tend to remain unused in a developing assembly, resulting in a deterioration due to running.

This tendency in digital latent image system becomes more remarkable, in image forming systems used for the purpose of printers, such as laser beam printers and liquid crystal shutter printers, because character images are mainly output. Developers conventionally used in such digital latent image systems, because of the special tendency in edge development, often cause a deterioration problem of image quality after running of a large number of sheets, as well as a thinner line-image problem in an environment of high humidity.

In reversal development carried out in image forming apparatus such as laser beam printers, smaller electrical charge is present at image areas and a greater electrical charge at the background on a photosensitive member. Hence, when conventional toners are used and toner particles having a smaller charge quantity are present, the toner particles are attracted to the background having a greater electrical charge. Thus, prevention of this reversal fog has been one of most important subjects in the past in this electrophotographic process.

In the meantime, for controlling the charge quantity (triboelectricity) of a dry one-component magnetic toner, it is known to externally add to a toner a material as exemplified by silica treated in gaseous conditions (hereinafter "dry silica") and silica treated under wet conditions (hereinafter "wet silica").

For example, the charge quantity required for a developer can be increased by dry-mixing a dry negative silica that exhibits strong negative characteristics (a silica obtained by adding 10 parts by weight of hexamethyldisilazane (HMDS) to 100 parts by weight of dry silica having a BET specific surface area of 100 $m^2/g$), in a negatively chargeable magnetic toner containing 100 parts by weight of a styreneacrylate type copolymer and 60 parts by weight of magnetite. When, a layer such developer is formed on a sleeve comprised of a cylindrical member made of a metal such as aluminum or stainless steel, it becomes possible to increase image density and also to obtain smoother images compared with a developer containing no silica.

In an environment of high humidity, however, it is not easy to obtain a satisfactory image density by only a conventional silica externally. In an environment of high temperature and/or high humidity (in particular, in an environment of high humidity), the silica contained in a developer causes a phenomenon of moisture absorption to bring about a decrease in charge quantity of the developer. It has been common that images with a good image density can be obtained in a low-humidity environment or a normal environment, but those with a low image density and coarseness are obtained in an environment of high humidity.

To cope with this problem, it has been attempted in several instances to subject the silica to a hydrophobic treatment so that the absorption of moisture in an environment of high humidity can be prevented.

However, with a developer, for example, comprising a negatively chargeable toner and the externally added negative silica which has been subjected to hydrophobic treatment, print patterns may remain on a developing sleeve sometimes to damage the reproduction of good line images. This phenomenon often occurs in an environment of low temperature and low-humidity, in particular, low humidity. According to the experiments and studies by the present inventors the mechanism of this phenomenon is greatly concerned with a layer of a fine powder (particle diameter: 5 to 6 microns or less), formed on the sleeve. A marked difference in particle size distribution at a lowermost layer of the toner on the developing sleeve is present between toner-consumed areas and toner-unconsumed areas. At the lowermost layer of the toner in the unconsumed areas, a fine powder layer is formed. Since the fine powder has a large surface area per volume, it prossesses a larger triboelectric charge quantity per mass than particles having a large particle diameter, and thus electrostatically strongly bound to the sleeve because of the mirror force of the fine powder itself. Hence, the toner present on the part at which the fine powder layer has been formed can not be sufficiently triboelectrically charged, tending to result in a lowering of development capacity in reproducing line images faithful to latent images.

The developer containing the silica pretreated for hydrophbicity shows a stable charge in an environment of high humidity, but causes an excessive increase in charge quantity in an environment of low humidity. In particular, the fine powder may become charged up to bring about a partial lowering of developing power. This tends to makes it difficult to faithfully develop the digital latent image, such as line images which are composed of dots.

A developing method in which a latent image formed on the surface of a photosensitive drum (an electrostatic latent image bearing member) is converted to a visible image using a magnetic toner as one-component developer, hitherto includes a method comprising i) imparting to the magnetic toner particles a charge with the opposite polarity to that of an electrostatic latent image formed on a photosensitive drum from development standard potential by mutual friction of the magnetic toner particles and also friction between a sleeve serving as a developer-carrying member and the magnetic toner particles, ii) transporting the magnetic toner particles thinly spread on the sleeve to a developing zone defined by the photosensitive drum and the sleeve, and iii) in the developing zone, transporting the magnetic toner particles by the action of a magnetic field of a magnet set inside the sleeve, thereby converting the electrostatic latent image on the photosensitive drum to a visible image.

The above conventional technique, however, has been involved in the problem that an area with a low density in a stripe appears when the same pattern is repeatedly printed. FIG. 2 diagrammatically illustrates an image having such an area.

This is a phenomenon in which lines of characters become thin in the case of character images and density becomes low in the case of halftone or solid black images. This phenomenon is hereinafter called "fading".

The above phenomenon of fading is particularly remarkable in an environment of high temperature and high humidity where the charge of a developer tends to lower.

SUMMARY OF THE INVENTION

An object of the present invention is to provide an image forming apparatus that has solved the problem stated above, and also provide an apparatus unit and a facsimile apparatus making use of such an apparatus.

Another object of the present invention is to provide an image forming apparatus capable of preventing occurrence of the fading and forming a uniform developed image, and also provide an apparatus unit and a facsimile apparatus making use of such an apparatus.

Still another object of the present invention is to provide an image forming apparatus capable of preventing occurrence of the fading in an environment of high temperature and high humidity and forming a uniform developed image, and also provide an apparatus unit and a facsimile apparatus making use of such an apparatus.

The objects of the present invention is to provide an image forming apparatus comprising an electrostatic latent image bearing member and a developing apparatus for developing an electrostatic latent image:

said developing apparatus comprising a developer container in which a developer is held, and a developer-carrying member which carries thereon the developer and transports the developer to a developing zone;

said developer-carrying member having a surface layer of a resin containing at least conductive fine particles and a solid lubricant, said surface layer having in its relative load curve (Abbot's load curve) a cutting depth $C_v$ of not more than 5 μm when a relative load length $t_p$ is 5%; and said developer comprising a toner and a fine powder treated with a silicone oil or silicone varnish.

The objects of the present invention can also be achieved by an apparatus unit comprising an electrostatic latent image bearing member and a developing apparatus for developing an electrostatic latent image;

said developing apparatus comprising a developer container in which a developer is held, and a developer-carrying member for carrying thereon the developer and transporting the developer to a developing zone;

said developer-carrying member having a surface layer of a resin containing at least conductive fine particles and a solid lubricant, said surface layer having in its relative load curve (Abbot's load curve) a cutting depth $C_v$ of not more than 5 μm when a relative load length $t_p$ is 5%; and said developer comprising a toner and a fine powder treated with a silicone oil or silicone varnish;

said developing apparatus being supported together with said electrostatic latent image bearing member to form a single unit, and said single unit being detachably provided in the body of an electrophotographic apparatus.

The objects of the present invention is to provide a facsimile apparatus comprising an electrophotographic apparatus and a receiver means for receiving image information from a remote terminal, wherein said electrophotographic apparatus comprises an electrostatic latent image bearing member and a developing apparatus for developing an electrostatic latent image;

said developing apparatus comprising a developer container in which which carries is held, and a developer-carrying member for carrying thereon the developer and transports the developer to a developing zone;

said developer-carrying member having a surface layer of a resin containing at least conductive fine particles and a solid lubricant, said surface layer having in its relative load curve (Abbot's load curve) a cutting depth $C_v$ of not more than 5 μm when a relative load length $t_p$ is 5%; and said developer comprising a toner and a fine powder treated with a silicone oil or silicone varnish.

DESCRIPTION OF THE PREFERRED EMBODIMENTS

A developing apparatus used in the image forming apparatus of the present invention will be described.

Figure 1:
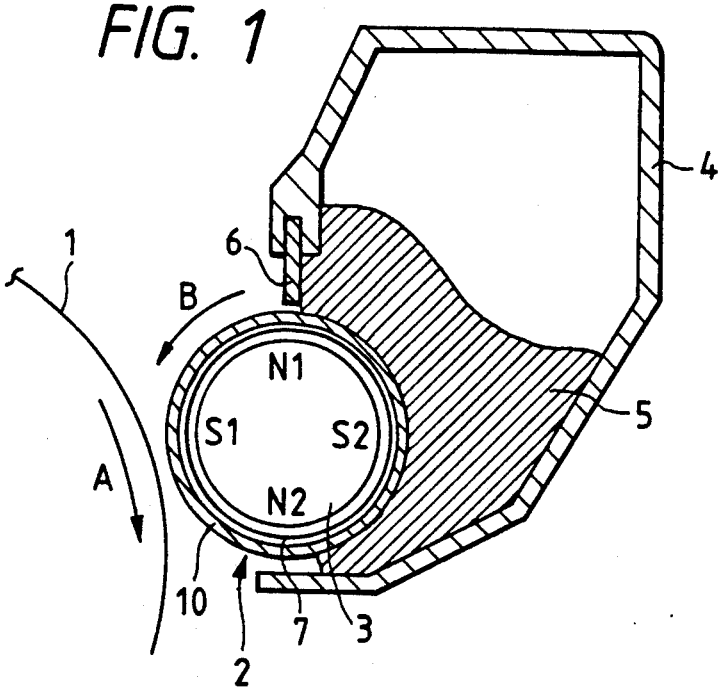
FIG. 1 is a schematic cross section of a developing apparatus used in the present invention.

FIG. 1 is a schematic cross section of an example of the developing apparatus of the present invention.

In the drawing, the numeral 1 denotes a photosensitive drum serving as an electrostatic latent image bearing member, which rotates in the direction of an arrow A. Any of those having or not having an insulating layer on the surface can be used. This member may also be in the form of a sheet or belt without limitation to the drum. The numeral 2 denotes a developing sleeve serving as a developer-carrying member, which rotates in the direction of an arrow B while bearing on its surface a developer 5 containing a toner. In the interior of the sleeve 2, a multi-pole permanent magnet is secured in nonrotatable state. On the surface of the developing sleeve 2, that is, substrate 7, a coat layer 10 containing conductive fine particles and/or a solid lubricant, as will be detailed later, is formed in a thickness of about 0.5 μm to about 30 μm, and preferably 2 μm to 20 μm. The numeral 4 denotes a developer container that holds the developer 5 and where the developer 5 is brought into contact with the surface of the developing sleeve 2. The numeral 6 denotes a doctor blade, a member that gives a certain thickness to the layer of the developer 5 preformed on the surface of the developing sleeve 2 in the developer holding chamber 4. The developing sleeve 2 and the doctor blade 6 are spaced preferably about 50 μm to about 500 μm.

Upon the driving of the developing apparatus constituted in this way, the developing sleeve rotates in the direction of the arrow B, the toner in the developer holding chamber 4 acquires a charge with the opposite polarity, with respect to development standard potential, to the charge of the electrostatic latent image formed on the photosensitive drum, mainly because of the contact friction between the developing sleeve 2 and the toner, so that the toner coats the surface of the developing sleeve 2. A layer of the developer thus formed on the sleeve surface is further ajusted to form a uniform and thin layer (layer thickness: about 30 μm to about 300 μm) by means of the doctor blade 6 set oppositely to one of the poles of the multi-pole permanent magnet 3 (the pole S in the drawing), and then the toner is transported to the developing zone defined by the photosensitive drum 1 and the developing sleeve 2.

In the developing zone, a bias such as AC bias or pulse bias may be applied across the developing sleeve 2 and the photosensitive drum 1 so that the toner particles in the developer on the developing sleeve 2 transported in the direction of the photosensitive drum.

The coating layer 10 (a resin coating layer) formed on the surface of the developing sleeve is described here.

The coating layer 10 comprises a layer-forming high polymer material and, contained therein, conductive fine particles and/or a solid lubricant. The conductive fine particles may preferably have a resistivity of not more than 0.5 Ω.cm as a value after application of a pressure of 120 kg/c.

Fine carbon particles are preferred as the conductive fine particles, and graphite (more preferably crystalline graphite) is preferred as the solid lubricant.

The crystalline graphite preferably used in the present invention can be roughly grouped into natural graphite and artificial graphite. The artificial graphite can be obtained by solidifying pitch coke with a material such as tar pitch, firing the solid product once at about 1,200° C., and putting the fired product in a graphitizing furnace, followed by treatment at a high temperature of about 2,300° C., whereby crystals of carbon grow into graphite. The natural graphite is a product of the earth, completely graphitized by subterranean heat and subterranean high pressure naturally applied for an infinite period. These graphites have various excellent properties, and hence have various industrial uses. Graphite is a glossy, very soft and lubricative crystal mineral with a dark-gray or black color, and is thermally resistant, chemically stable and excellent in lubricity. Its crystal structure is hexahedral and the sides rhombohedral, having a perfect layer structure. With regard to its electrical characteristics, it has tree electrons present between bonds of carbon to carbon, giving a good conductor of electricity. The graphite used in the present invention may be any of the natural products and the artificial products.

The graphite used in the present invention may preferably be those having a particle diameter of 0.5 μm to 10 μm.

Conductive amorphous carbon is defined, in general, as "a mass of crystallites produced by combustion or pyrolysis of a hydrocarbon or a carbon-containing compound conducted with an insufficient supply of air". In particular, it has an excellent electrical conductivity, and when loaded into a high polymer material, it can impart an electrical conductivity thereto, wherein electrical conductance can be changed to a certain degree by controlling its amount.

The conductive amorphous carbon used in the present invention may preferably have a particle diameter of 5 mμ to 100 mμ, more preferably 10 mμ to 80 mμ, and still more preferably 15 mμ to 40 mμ.

The conductive fine particles and/or the solid lubricant may preferably be used in an amount of 3–20 parts by weight to 10 parts by weight of the resin component.

When fine carbon particles and graphite particles are used in combination, it is preferred to use carbon particles in an amount of 1–50 parts by weight to 10 parts by weight of graphite particles.

The resin coating layer on the sleeve, in which the conductive fine particles and/or solid lubricant are dispersed, may preferably have a volume resistivity of $10^{-6}$ Ω.cm to $10^{6}$ Ω.cm.

As the resin component, the coating layer-forming high polymer material, it is possible to use, for example, thermoplastic resins such as styrene resins, vinyl resins, polyethersulfone resins, polycarbonate resins, polyphenylene oxide resins, polyamide resins, fluorine resins, cellulose resins and acrylic resins; and thermosetting or photocurable resins such as epoxy resins, polyester resins, alkyd resins, phenol resins, melamine resins, polyurethane resins, urea resins, silicone resins and polyimide resins. In particular, it is more preferred to use those having releasability as exemplified by silicone resins and fluorine resins, or those having excellent mechanical properties as exemplified by polyethersulfone, polycarbonate, phenylene oxide, polyamide, phenol, polyester, polyurethane or styrene resins. Phenol resins are particularly preferred.

The phenomenon of fading will be detailed below, which is the subject to be solved by the present invention.

When the fading has occurred, it is observed that the toner layer is uniformly formed on the sleeve surface. Hence the fading is a phenomenon different from the blank area phenomenon which happens when the toner is nearly run out. Measurement of the electrical charge quantity (hereinafter called "triboelectricity") on the sleeve has revealed that the triboelectricity of the toner has a lower value than the toner in a normal state. Not only the normally charged toner particles but also the insufficiently charged toner particles pass through the concentrated electric field formed between the blade 6 and magnet 3 as shown in FIG. 1, to form a toner layer by the action of frictional force exerted from the sleeve surface. This brings about a decrease in the triboelectricity of the toner layer to give the part or area of the photosensitive drum where toner is not transferred when the toner comes into the alternate electric field between the photosensitive drum and the sleeve. Thus the fading occurs. In order to prevent it, it is necessary to increase the triboelectricity of the toner in the developer layer. If the toner particles passing through the concentrated electric field formed between the blade 6 and magnet 3, pass through the concentrated electric field not because of the frictional force received from the sleeve surface but because of the mirror force acting between the toner and the sleeve, it becomes possible to form the developer layer comprised of toner particles having normal triboelectricity with a large mirror force. Thus the fading can be prevented. In order to decrease the friction on the sleeve surface and increase its lubricity, no sure effect can be realized only by making smaller the value of center line average roughness (hereinafter "Ra", prescribed in JIS B0601, a value hitherto used to determine the surface roughness of a sleeve). Rather, a decrease in Ra results in such a disadvantage that the quantity of coated toner contained in the developer on the sleeve becomes short.

The sleeve of the present invention may be produced by coating, for example, coating a crude tube (surface roughness: 2S) obtained by the drawing of aluminum, with a solution prepared according to any of Formulation Examples shown below by spraying to a coating thickness of about 0.5 μm to about 30 μm, followed by heat-curing in a drying oven (temperature: 150° C.).

| | |
|---|---|
| Formulation Example 1 | |
| Resin: Phenol resin (solid content) | 30 parts |
| Carbon: Amorphous carbon (CONDUCTEX 975 UB; available from Columbian Carbon Japan Limited) | 25 parts |
| Diluent: Methyl alcohol/methyl cellosolve | 200 parts |
| Formulation Example 2 | |
| Resin: Phenol resin (solid content) | 15 parts |
| Conductive lubricant: Artificial graphite (1 μm) | 15 parts |
| Diluent: Methyl alcohol/methyl cellosolve | 225 parts |

Using the above materials and the above process, a resin-coated sleeve can be prepared. By the above process only, however, it is difficult to reduce a cutting depth $C_v$ not more than 5 μm when a relative load length $t_p$ is 5%. To avoid such a difficulty, it is effective to additionally polish the resin coating layer surface of the sleeve. For example, the resin coat surface may be additionally polished using felt. This polishing will be described by giving an example. The dried resin-coated sleeve is brought into contact with felt under a pressure of about 1 kg to about 3 kg with rotation at about 800 rpm. By moving the felt from one end to the other end of the resin-coated sleeve in its longitudinal direction at a speed of 1 cm/sec to 5 cm/sec, the polishing can be completed. The polishing is by no means limited to this method, and can also be carried out using a material such as cloth or waste or by directly polishing by hand without rotation of the sleeve. In this way the resin-coated sleeve used in the present invention can be prepared.

The relative load curve of the sleeve surface is described below.

Figure 3:
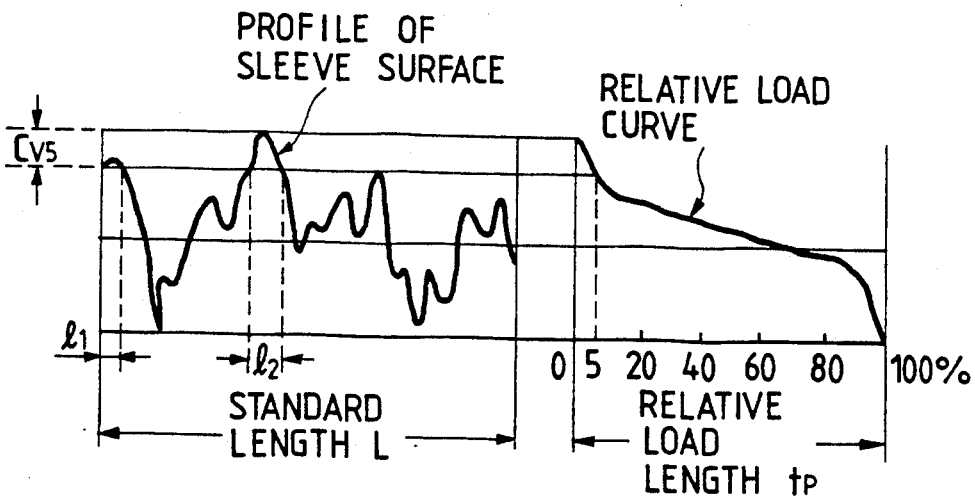
FIG. 3 is a view to describe the relative load curve.

FIG. 3 shows a profile (cross-sectional curve) per standard length of the sleeve surface and the relative load curve (Abbot's load curve) corresponding therewith. The relative load curve refers to the following: In a section per standard length L (2.5 mm), the profile line is cut with a straight line at a certain level parallel to the average line in that section (the distance from the highest peak within the standard length L section to that level is called the cutting depth $C_v$). The ratio of the total length of the segments $l_1+l_2 \ldots +l_n$ at the level to the standard length L is called the relative load length $t_p$ at that level (the cutting depth). A graphic representation of the relationship between this cutting depth and the relative load length is the relative load curve.

In FIG. 3, what is meant by "the relative load length $t_p$ is 5%" means $t_p=l_1+l_2/L\times 100=5\%$, and the cutting depth in that instance is $C_{v5}$.

In Examples described later, a surface roughness meter SE-30H, a trade name, manufactured by Kosaka Laboratory Ltd., was used. In the present invention, taking note of the cutting depth $C_v$ for the relative load length $t_p$ of 5%, the cutting depth $C_v$ is set to be not more than 5 μm ($C_v \leqq 5$ μm), and preferably 0.5 μm to 5 μm, thereby preventing the fading from occurring.

The reason that the cutting depth $C_v$ value for the relative load length $t_p$ of 5% is related to the rate of occurrence of the fading, but the center line average roughness Ra is not related with the rate of occurrence of the fading, is explained below.

Figure 4:
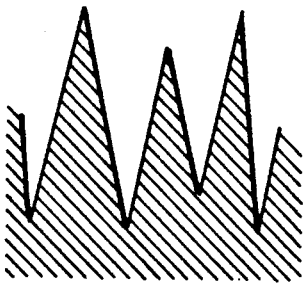
FIGS. 4 and 5 diagrammatically illustrate surface profiles of coated sleeves.
Figure 5:
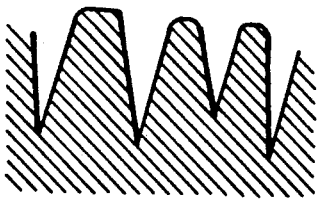

FIG. 4 is a diagrammatical profile showing a part of the surface of a coated sleeve A (a comparative example), in which $C_{v5}$ is 10 μm and Ra is 2.5 μm. On the other hand, a coated sleeve B (the present invention) was prepared by applying the surface polishing to the surface of the coated sleeve A, to have $C_{v5}$ of 1.0 μm and Ra of 2.0 μm. A diagrammatic profile of partial surface of the coated sleeve B is shown in FIG. 5.

In comparison between the coated sleeves A and B (after polishing), the value $C_{v5}$ has significantly changed from 10 μm to 1.0 μm, but the value Ra has only changed from 2.5 μm to 2.0 μm. The difference between the sleeves A and B is clearly seen from the profiles. In the coated sleeve A, the values of both the $C_{v5}$ are great because its profile has sharp protrusions and great roughness. In the coated sleeve B, on the other hand, the value $C_{v5}$ is small because the projections of the surface profile have been rounded as a result of the surface polishing, but the recesses of the coated sleeve B are unchanged, and Ra remains as a relatively large value. With regard to the fading, the coated sleeve A with sharp protrusions has a poor lubricity causing fading. The coated sleeve B, whose projections had been rounded, showed a good lubricity on the sleeve surface to cause no fading.

It has become clear that when the $C_{v5}$ value on the surface of the coated sleeve is specified as described above, the lubricity of the surface of the coated sleeve can be improved to prevent fading phenoenon.

Data on the coated sleeve A and the coated sleeve B are shown in Table 1 below.

TABLE 1

| | Coated sleeve A (comparative) | Coated sleeve B (the invention) |
|---|---|---|
| Profile: | See FIG. 4 | See FIG. 5 |
| Cv ($C_{v5}$) when $t_p$ is 5%: | | |
| Ra: | 10 μm, large<br>2.5 μm, large | 1.0 μm, small<br>2.0 μm a little large |
| Lubricity of sleeve surface; | | |
| Fading: | Poor<br>Occurs | Good<br>Does Not occur |

As described above, the fading can be prevented from its occurrence when the $C_{v5}$ value is controlled to be $C_v \leqq 5$ μm. In order to control the $C_{v5}$ value to be $C_v \leqq 5$ μm, it is effective to apply surface polishing to the sleeve surface.

Although as previously described, the controlling of Ra is not a sure means for preventing occurrence of the fading, with a value $Ra < 0.4$, such unpreferable phenomenona tend to occur, that image density becomes low because of shortage in the quantity of the toner layer on the sleeve or the developer layer becomes uneven because of non-uniform charge of the toner. Hence, the value Ra should preferably be $Ra \geqq 0.4$ μm, and more preferably $Ra \geqq 0.5$ μm.

In order to control the $C_{v5}$ value to be not more than 5 μm, blast finishing of the coated sleeve surface after it has been dried can be conducted. For example, the blast finishing can be carried out using a processing machine such as a blast finishing machine manufactured by Fuji Seisakusho K.K., and using abrasive grains such as Arandom #400 (trade name). A cleaning step such as alcohol cleaning may be added so that fine powder resulting from the abrasion by blast finishing can be removed.

The developer according to the present invention is described below.

The developer according to the present invention contains a fine powder treated with a silicone oil or silicone varnish, in such a form that the fine powder is held on (or adhered to) the surfaces of toner particles.

The developer according to the present invention, whose constitution is described above, makes it possible to prevent fading particularly in an environment of high temperature and high humidity and to fully exploit the performance of the coated sleeve of the present invention.

The developer according to the present invention is well-matched with the image forming apparatus of the present invention, and is a developer that can satisfactorily make the most of the image forming apparatus. An excellent image forming method can be provided when the developer and the image forming apparatus according to the present invention are used together.

The present inventors consider the reason as follows: A developer having a high chargeability and capable of maintaining it even in an environment of high temperature and high humidity can fulfill the requirements of the coated sleeve which shows good lubricity because of the controlling of its $C_{v5}$, reducing the dynamic transportation of the developer and increasing the opportunity of contact charging because of the slippage of the developer. Thus a uniformly charged developer layer can be formed.

It is preferred for the fine powder used in the present invention to have a particle diameter in the range of 0.001μ to 2μ, and particularly preferably 0.005μ to 0.2μ. The fine powder used in the present invention may preferably be made of an inorganic compound. For example, preferred are Group III or Group IV metal oxides such as silica, alumina and titanium oxide.

In particular, fine silica powder is preferred. As a fine silica powder, it is possible to use both of dry silica (or a fumed silica) produced by vapor phase oxidation of a silicon halide, and wet silica produced from water glass. The dry silica is preferred, as having less silanol groups present at the surface and inside, of the fine silica powder and being free of manufacture residues such as $Na_2O$ and $So_3^{2-}$.

In regard to the dry silica, in its manufacturing steps, a composite fine powder of silica and other metal oxide can be obtained, for example, by using other metal halide such as aluminum chloride or titanium chloride together with a silicon halide. Such a product is also included in the fine powder in the present invention.

In the treatment with a silicone oil, of the fine powder used in the present invention, the particle surfaces of the fine powder is coated with the silicone oil, whereby the silanol groups can be concealed and thus the moisture resistance can be greatly improved.

The solid matter of the silicone oil or silicone varnish used in the present invention is represented, for example, by the following formula:

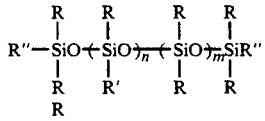

wherein R represents an alkyl group having 1 to 3 carbon atoms; R′ represents a silicone oil-modifying group such as alkyl, halogen-modified alkyl, phenyl and modified phenyl; R″ represents an alkyl group or an alkoxyl group having 1 to 3 carbon atoms; m represents a positive integer; and n represents an integer.

The silicone oil may include, for example, dimethylsilicone oil, alkyl-modified silicone oil, α-methylstyrene-modified silicone oil, chlorophenylsilicone oil and fluorine-modified silicone oil. The above silicone oil may preferably be those having a viscosity of 50 cSt to 1,000 cSt at 25° C. A silicone oil with an excessively low molecular weight tends to produce a volatile component as a result of heat treatment. On the other hand, a silicone oil with an excessively high molecular weight results in an excessively high viscosity to make it difficult to carry out the treatment.

As a method for the silicone oil treatment, any conventional methods can be used. For example, the fine silica powder and the silicone oil may be directly mixed using a mixer such as a Henschel mixer, or the silicone oil may be sprayed to the base fine silica powder. The silicone oil may also be treated by forming it into a varnish, which is then mixed with the base fine silica powder, followed by removal of solvent.

The fine powder used in the present invention may more preferably be first treated with a silane coupling agent and thereafter treated with the silicone oil or silicone varnish.

The mere treatment with the silicone oil may usually require an excessively large quantity of the silicone oil to cover the fine powder particles surfaces, tending to give agglomerates of fine powder during treatment. If such a fine powder is applied to the developer, it is possible that the developer may come to have a poor fluidity. Hence it is necessary to take great care in the treatment with silicone oils. Now, in order to avoid the agglomerates of the fine powder while keeping a good moisture resistance, it is recommended treating the fine powder with a silane coupling agent followed by treatment with the silicone oil, so that the treatment with silicone oil can be made well effective.

The silane coupling agent used in the present invention is represented by the general formula:

$$R_mSiY_n$$

wherein R represents an alkoxyl group or a chlorine atom; m represents an integer of 1 to 3; Y represents a hydrocarbon group including an alkyl group, a vinyl group, a glycidoxy group or a methacrylic group; and n represents an integer of 3 to 1.

It may typically include dimethyldichlorosilane, trimethylchlorosilane, allyldimethylchlorosilane, hexamethyldisilazane, allylphenyldichlorosilane, benzyldimethylchlorosilane, vinyltriethoxysilane, γ-methacryloxypropyltrimethoxysilane, vinyltriacetoxysilane, divinylchlorosilane, and dimethylvinylchlorosilane.

The treatment of the above fine powder with a silane coupling agent can be carried out by a dry treatment in which the fine powder formed into a cloud by stirring is reacted with a vaporized silane coupling agent, or a wet method in which the fine powder dispersed in a solvent is reacted with a silane coupling agent dropwise added thereto.

The silane coupling agent should preferably be used for treatment in an amount of 1 part by weight to 50 parts by weight, and more preferably 5 parts by weight to 40 parts by weight, based on 100 parts by weight of the fine powder.

In the treatment with the silicone oil or silicone varnish, the solid matter thereof should preferably be in an amount of 1 part by weight to 35 parts by weight, and more preferably 2 parts by weight to 30 parts by weight, based on 100 parts by weight of the fine powder. Use of an excessively small amount of the silicone oil may bring about the same results as in the case of the treatment with the silane coupling agent only, so that the moisture resistance is not sufficient to prevent the fine powder from absorbing moisture in an environment of high humidity making it impossible to obtain a copy image with a high quality level. An excessively large amount of the silicone oil tends to result in the formation of agglomerates of the fine powder as previously noted. In an extreme case, free silicone oil is produced causing the problem that the fluidity can not be improved when applied to the developer.

The amount of the thus treated fine powder applied to the developer may preferably be in the range of 0.01 part by weight to 20 parts by weight, and more preferably 0.1 part by weight to 5 parts by weight, based on 100 parts by weight of the toner.

A binder resin used in the toner according to the present invention can be exemplified by homopolymers of styrene with a derivative thereof, such as polystyrene and polyvinyltoluene; styrene copolymers such as a styrene/propylene copolymer, a styrene/vinyltoluene copolymer, a styrene/vinylnaphthalene copolymer, a styrene/methyl methacrylate copolymer, a styrene/ethyl acrylate copolymer, a styrene/butyl acrylate copolymer, a styrene/octyl acrylate copolymer, a styrene/dimethylaminoethyl acrylate copolymer, a Styrene/methyl methacrylate copolymer, a styrene/ethyl methacrylate copolymer, a styrene/butyl methacrylate copolymer, a styrene/dimethylaminoethyl methacrylate copolymer, a styrene/methyl vinyl ether copolymer, a styrene/ethyl vinyl ether copolymer, a styrene/methyl vinyl ketone copolymer, a styrene/butadiene copolymer, a styrene/isoprene copolymer, a styrene/maleic acid copolymer and a styrene/maleate copolymer; polymethyl methacrylate, polybutyl methacrylate, polybutyl methacrylate, polyvinyl acetate, polyethylene, polypropylene, polyvinyl butyral, polyacrylic acid resins, rosins, modified rosins, terpene resins, phenol resins, aliphatic or alicyclic hydrocarbon resins, aromatic petroleum resins, paraffin waxes, and carnauba waxes. These may be used alone or in combination.

As the binder resin for the toner used in the present invention, it is preferred to use a resin having a polymerizable monomer unit containing an acid group comprised of a carboxyl group or an acid anhydride thereof.

As the reason therefor, the present inventors consider that a remarkable uniformity of the triboelectric charging of a toner can be obtained and also the lubricity can be improved with the controlling of $C_{v5}$ when the resin having a polymerizable monomer unit containing an acid group comprised of a carboxyl group or an acid anhydride thereof is used in the toner. In other words, such a resin well matches what is required by the sleeve that is capable of increasing the opportunity of contact charging because of the slippage of the developer, and hence it has become possible to form a uniformly charged developer layer even in an environment of high temperature and high humidity.

Various resins can be used as the binder resin having the acid group according to the present invention. The polymerizable monomer containing the acid group may include the following:

That is, it may include α,β-unsaturated carboxylic acids such as acrylic acid and methacrylic acid; α,β-unsaturated dicarboxylic acids such as maleic acid, butyl maleate, octyl maleate, fumaric acid and butyl fumarate, or half esters thereof; alkenyl dicarboxylic acids such as n-butenylsuccinic acid, n-octenylsuccinic acid, butyl n-butenylsuccinate, n-butenylmalonic acid and n-butenyladipic acid, or half esters thereof. It is preferred to use dicarboxylic acids and derivatives thereof that can be formed into anhydrides.

Here, the polymerizable monomer containing the acid group may preferably be used in an amount of 2 parts by weight to 30 parts by weight based on the total weight of the binder resin. The acid value of the whole binder resin may preferably be 1 to 70, and more preferably 5 to 50.

The acid value measuring method used in the present invention is described below.

The acid value is measured according to JIS K-0670. Namely, 2 to 10 g of a sample is weighed in a 200 to 300 ml Erlenmeyer flask, to which 50 ml of a 1:2 mixed solvent of ethanol and benzene is added to dissolve the resin. If the resin has a poor solubility, acetone may be added in a small amount. Using phenolphthalein as an indicator, titration is carried out with a previously standardized N/10 potassium hydroxide-ethanol solution. On the basis of the consumption of the alcohol potassium hydroxide solution, the acid value is calculated according to the following expression.

$$\text{Acid value} = \text{KOH (ml number)} \times N \times 56.1/\text{sample weight}$$

wherein N is a factor of N/10 KOH.

Comonomers used to obtain the binder resin according to the present invention may include the following vinyl monomers.

They can be exemplified by styrene; styrene derivatives such as o-methylstyrene, m-methylstyrene, p-methylstyrene, p-methoxylstyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene and p-n-dodecylstyrene; ethylene unsaturated monoolefins such as ethylene, propylene, butylene and isobutylene; unsaturated polyenes such as butadiene; vinyl halides such as vinyl chloride, vinylidene chloride, vinyl bromide and vinyl fluoride; vinyl esters such as vinyl acetate, vinyl propionate, vinyl benzoate; α-methylene aliphatic monocarboxylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimetbylaminoethyl methacrylate and diethylaminoethyl methacrylate; acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; vinyl ethers such as vinyl methyl ether, vinyl ethyl ether, vinyl isobutyl ether; vinyl ketones such as vinyl methyl ketone, vinyl hexyl ketone and methyl isopropenyl ketone; N-vinyl compounds such as N-vinylpyrrole, N-vinylcarbazole, N-vinylindole and N-vinylpyrrolidone; vinyl naphthalenes; and acrylic acid derivatives or methacrylic acid derivatives such as acrylonitrile, methacrylonitrile and acrylamide. These vinyl monomers are used alone or in combination of two or more kinds.

Of these, preferred are monomer combinations that may form styrene copolymers or styrene-acrylate copolymers.

The vinyl copolymers used in the present invention may preferably be copolymers cross-linked with cross-linkable monomers as exemplified by the following.

The cross linking mononers may include aromatic divinyl compounds as exemplified by divinyl benzene and divinyl naphthalene; diacrylate compounds linked with an alkyl chain, as exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and those in which the acrylate in any of the above compounds has been replaced with methacrylate; diacrylate compounds linked with an alkyl chain containing an ether bond, as exemplified by diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and those in which the acrylate in any of the above compounds has been replaced with methacrylate; diacrylate compounds linked with a chain containing an aromatic group and an ether bond, as exemplified by polyoxyethylene (2)-2,2-bis(4-hydroxyphenyl)-propanediacrylate, polyoxyethylene (4)-2,2-bis(4-hydroxyphenyl)propanediacrylate, and those in which the acrylate in any of the above compounds has been replaced with methacrylate; and diacrylate compounds of a polyester type, as exemplified by MANDA (trade name; available from Nippon Kayaku Co., Ltd.

A polyfunctional cross-linking agent may include pentaerythritol triacrylate, trimethylolethone triacrylate, trimethylolpropan triacrylate, tetramethylolmethane tetraacrylate, oligoester acrylate, and those in which the acrylate in any of the above compounds has been replaced with methacrylate; triallylcyanurate, and triallyltrimellitate.

These cross-linking agents may preferably be used in an amount of 0.01 part to 5 parts by weight, and more preferably 0.03 part by weight to 3 parts by weight, based on 100 parts by weight of other monomer components.

Of these cross-linking monomers, those preferably used in view of fixing performance and anti-offset of the toner are the aromatic divinyl compounds (in particular, divinyl benzene), and the diacrylate compounds linked with a chain containing an aromatic group and an ether bond.

As methods for synthesizing the binder resin according to the present invention, it is possible to use a method of synthesizing basically two or more kinds of polymers.

It is a method in which a first polymer soluble in THF and also soluble in a second polymerizable monomer is dissolved in polymerizable monomers and then the monomers are polymerized to give a resin composition containing cross-linked resin components. In this instance, a composition is formed in which the first polymer and the second cross-linked polymer are uniformly mixed.

The first polymer soluble in THF may preferably be obtained by solution polymerization or ionic polymerization. The second polymer for producing a component insoluble to THF may preferably be synthesized by suspension polymerization or bulk polymerization in the presence of a cross-linkable monomer under conditions where the first polymer is dissolved therein. The first polymer may preferably be used in an amount of 10 parts by weight to 120 parts by weight, and preferably 20 parts by weight to 100 parts by weight, based on 100 parts by weight of polymerizable monomers used for the formation of the second polymer.

The solvent used in the solution polymerization may include xylene, toluene, cumene, cellosolve acetate, isopropyl alcohol and benzene. In the case of styrene monomers, xylene, toluene or cumene is preferred. These may be appropriately selected depending on the polymer to be produced by polymerization. A polymerization initiator used therefor may include di-tert-butyl peroxide, tert-butylperoxybenzoate, benzoyl peroxide, 2,2'-azcbisisobutyronitrile, and 2,2'-azobis(2,4-dimethylvaleronitrile), which may be used in a concentration of not less than 0.1 part by weight, and preferably 0.4 part by weight to 15 parts by weight, based on 100 parts by weight of monomers. Reaction temperature may vary depending on the solvent used, the initiator and the polymer obtained by polymerization. The reaction may preferably be carried out at 70° C. to 180° C. The solution polymerization may preferably be carried out using 30 parts by weight to 400 parts by weight of monomers based on 100 parts by weight of the solvent.

In solution polymerization carried out using $\alpha,\beta$-unsaturated dicarboxylic acids or half esters thereof, cyclization is known to take place to a certain extent because of formation of anhydrides when a reaction solvent is evaporated by raising temperature after completion of the reaction. This has been confirmed by IR also in the present invention.

Various resins can be used as the binder resin having the acid group according to the present invention. Preferred resins are those having a weight average molecular weight/number average molecular weight (Mw/Mn) of $\geqq 5$ in the molecular weight distribution measured by GPC (gel permeation chromatography) of a THF-soluble matter, a molecular weight peak in the region of a molecular weight of from 2,000 to 10,000 and a molecular weight peak or shoulder in the region of a molecular weight of from 1,500 to 100,000. This is based on the fact that the component having a molecular weight of not more than 10,000 in the THF-soluble matter influences mainly the blocking resistance, melt-adhesion to photosensitive members, and filming properties, and the component having a molecular weight of not less than 10,000 in the THF-soluble matter influences the fixing performance.

The copolymer containing the acid group comprised of a carboxyl group or an acid anhydride thereof may be distributed in any one or both of the above regions of molecular weight distribution.

In the present invention, the molecular weight at the peak and/or shoulder on the chromatogram obtained by GPC (gel permeation chromatography) is/are measured under the following conditions.

Columns are stabilized in a heated chamber of 40° C. To the columns kept at this temperature, THF (tetrahydrofuran) as a solvent is flowed at a flow rate of 1 ml per minute, and 50 $\mu$l to 200 $\mu$l of a THF solution of a resin sample prepared to have a sample concentration of 0.05% by weight to 0.6% by weight is injected thereinto to make measurement. In measuring the molecular weight of the sample, the molecular weight distribution ascribed to the sample is calculated from the relationship between the logarithmic value and count number of a calibration curve prepared using several kinds of monodisperse polystyrene standard samples.

As the standard polystyrene samples used for the preparation of the calibration curve, it is suitable to use, for example, samples with molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$, which are available from Pressure Chemical Co. or Toyo Soda Manufacturing Co., Ltd., and to use at least about 10 standard polystyrene samples. An RI (refractive index) detector is used as a detector.

Columns should be used in combination of commercially available polystyrene gel columns so that the regions of molecular weights of from $10^3$ to $4\times10^6$ can be accurately measured. For example, they may preferably comprise a combination of $\mu$-Styragel 500, $10^3$, $10^4$ and $10^5$, available from Waters Co.; Shodex KF-80M or a combination of KF-802, 803, 804 and 805, available from Showa Denko K.K.; or a combination of TSKgel G1000H, G2000H, G2500H, G3000H, G4000H, G5000H, G6000H, G7000H and GMH, available from Toyo Soda Manufacturing Co., Ltd.

To determine the % by weight of that having a molecular weight of not more than 10,000 in the binder resin, the weight ratio of a cutting of a GPC chromatogram area for a molecular weight of less than 10,000 to a cutting with a molecular weight of 10,000 or more is calculated, and the % by weight based on the whole binder resin is calculated using the % by weight of the THF-insoluble matter previously described.

According to the studies made by the present inventors, the acid group contained in the developer may more preferably be comprised of a dicarboxylic acid than a monocarboxylic acid in view of charge stability, when compared on the basis of the same acid value.

As a coloring material that can be further added to the developer according to the present invention, it is possible to use conventionally known pigments or dyes such as carbon black, cupper phthalocyanine and azo dyes.

As magnetic particles that can be contained in the magnetic toner according to the present invention, materials capable of being mangetized when placed in a magnetic field, powders of ferromagnetic metals such as iron, cobalt and nickel, and alloys or compounds such as magnetite, $\gamma$-$Fe_2O_3$ and ferrite can be used.

These magnetic fine particles may preferably have a BET specific surface area, measured by the nitrogen adsorption method, of 1 $m^2/g$ to 20 $m^2/g$, and particularly preferably 2.5 $m^2/g$ to 12 $m^2/g$. Magnetic powder with a Mohs hardness of 5 to 7 is more preferred. This magnetic powder may be contained in an amount of 10% by weight to 70% by weight based on the weight of the toner.

The magnetic particles used in the present invention may preferably have a bulk density of not less than 0.35 $g/cm^3$.

The present inventors consider that the reason for which the toner according to the present invention can have the effect as stated above is the uniform dispersibility of the magnetic particles in the toner. It is presumed that without uniform dispersion toner particles have non-uniform gravity distribution and charge distribution, which brings about poor lubricity and fluidity of the toner and a low and non-uniform developability.

The bulk density of a magnetic material can be regarded as an indirect indication of the quantity of agglomerates present in magnetic particles, i.e., the dispersibility. When the bulk density of a magnetic material is less than 0.35 $g/cm^3$, agglomerates are present in the magnetic material in so large a number that no sufficient dispersibility can be attained for the developer binder resin. This presumably causes localization of the magnetic material particles.

For the magnetic material to attain a good state of dispersion in the toner, it is preferred to use magnetic particles having a bulk density of not less than 0.35 $g/cm^3$, and more preferably not less than 0.5 $g/cm^3$.

In the present invention, the bulk density of the magnetic material refers to a value measured according to JIS (Japan Industrial Standard) K-5101.

The magnetic material contained in the toner according to the present invention may preferably have a coercive force (Hc) of not more than 100 Oe, and more preferably not more than 80 Oe, in a magnetic field of 10,000 Oe.

In magnetic particles, the coercive force can be regarded as an indirect indication of the surface form of crystals for the magnetic anisotropy and form anisotropy predominance. As a magnetic material becomes crystalline, the coercive force increases and the magnetic particles come to have sharp edges on their surfaces. If a toner containing magnetic particles having such edges on their surfaces is used in the present invention, there is a possibility that the lubricity, fluidity, etc. of the toner are damaged because any localized charges are concentrated to the edges or the toner itself tends to become distorted. Hence, it is preferred for the magnetic material to have a small coercive force and to make its particles have substantially curved surfaces as far as possible. However, the coercive force can be in a value of not more than 100 Oe when the agglomerates are formed in the magnetic particles. Therefore, it is preferred for the bulk density to be not less than 0.35 $g/cm^3$.

In the magnetic material contained in the toner according to the present invention, it is also preferred to use magnetic particles having a remanent magnetization ($\sigma r$) of not more than 10 emu/g, and preferably not more than 7 emu/g, in a magnetic field of 10,000 Oe. Use of a magnetic material with a remanent magnetization more than 10 emu/g may result in a great magnetic agglomeration of the magnetic particles, so that they tend to be present in the toner in the form of agglomerates. This localized presence of the magnetic material is not preferred since it causes the toner to become non-uniform as previously stated.

Magnetic characteristics of the magnetic material refer to values measured using VSMP-1, a trade name, manufactured by Toei Kogyo K.K.

The magnetic toner according to the present invention have triboelectric charges and hence is substantially electrically insulative. Stated specifically, it may preferably have a resistivity of not less than $10^{14}$ Ω.cm when a voltage of 100 V is applied under application of a pressure of 3.0 $kg/cm^2$. The magnetic material according to the present invention, having a bulk density of not less than 0.85 $g/cm^3$, may preferably be contained in an amount of 30 parts by weight to 150 parts by weight, and more preferably 45 parts by weight to 100 parts by weight, based on 100 parts by weight of the binder resin. Use thereof in an amount less than 30 parts by weight tends to result in an unsatisfactory transport performance of the magnetic toner on a toner-carrying member such as a sleeve. Use thereof in an amount more than 150 parts by weight tends to result in a lowering of the insulation properties and heat-fixing performance of the magnetic toner.

The magnetic material according to the present invention may preferably be produced by a wet method using ferrous sulfate as a starting material. It may preferably be formed of magnetite or ferrite containing a compound of a divalent metal such as manganese or zinc in an amount of 0.1% by weight to 10% by weight.

The magnetic material contained in the toner according to the present invention may preferably be those having been disintergrated if necessary. A means used for disintegrating the magnetic material can be exemplified by a mechanical grinding machine equipped with a high-speed rotator for disintegrating powders, and a pressure dispersion machine equipped with a press roller for dispersing or disintegrating powders.

In the case when the agglomerates of magnetic particles are disintegrated using the mechanical grinding machine, the impact force applied by the rotator tends to be exerted also to the primary particles of the magnetic particles, so that the primary particles per se tend to be broken to give fine power of the magnetic particles. Hence, when the magnetic material disintegrated by the mechanical grinding machine is used as the starting material of the toner, the fine powder of the magnetic particles may come to the surface of the developer in a large proportion if it is present in a large quantity. This may result in an increased abrasion effect of the developer itself to make the characteristics set aside from what has been originally sought.

Therefore, the pressure dispersion machine equipped with a press roller, as exemplified by a fret mill, is preferred in view of the efficiency in integration of agglomerates and the prevention of fine powdery magnetic particle formation.

The toner according to the present invention may also optionally contain a charge control agent. For example, a negative charge control agent may be used, which is exemplified by a metal salt complex of a monoazo dye and a metal complex salt of salicylic acid, alkylsalicylic acid, dialkylsalicylic acid or naphthoic acid.

The toner contained in the developer used in the present invention may preferably contain a metal complex compound (A) of an aromatic hydroxycarboxylic acid containing a lipophilic group and a metal complex salt type monoazo dye (B) having a hydrophilic group.

Herein, the lipophilic group refers to a group of non-polar atoms having a very small affinity for water and hence having a great affinity for oil. A main lipophilic group may include chain hydrocarbon groups, alicyclic hydrocarbon groups and aromatic hydrocarbon groups.

The lipophilic group the metal complex compound (A) has in its structure may preferably be a chain hydrocarbon group (in particular, an alkyl group) directly bonded to a cyclic (monocyclic or polycyclic) hydrocarbon.

In the metal complex compound (A) having such a lipophilic group, the aromatic hydroxycarboxylic acid serving as a ligand may preferably have a benzene ring or naphthalene ring, and may preferably be coordinated to the metal atom through a carboxyl group and a hydroxyl group.

As for the hydrophilic group mentioned above, it refers to a group of polar atoms having a strong mutual action with water. A main hydrophilic group may include $-SO_3H$, $-SO_3M$, $-COOM$, $-NR_3X$, $-COOH$, $-NH_2$, $-CN$, $-OH$, $-NHCONH_2$, $-X$, and $-NO_2$, wherein R is an alkyl group, M is an alkali metal or $-NH_4$ and X is a halogen atom. In the present invention, what is preferably used as the hydrophilic group is halogen (—X), carboxyl (—COOH), hydroxyl (—OH), nitro ($-NO_2$), sulfo ($-SO_3H$) or sulfoamino ($-SO_3NH_4$).

The monoazo dye (B) having such a hydrophilic group may preferably have a benzene ring or naphthalene ring in its ligand, and may preferably have a structure of O,O'-dioxyazo type.

The lipophilic group or hydrophilic group described above may preferably be directly bonded to a monocyclic or polycyclic hydrocarbon group in the structure, as exemplified by a benzene ring or naphthalene ring.

Both of these compounds (A) and (B), when respectively added in the toner alone, have the same effect as charge control agents. In the present invention, the distribution uniformity of triboelectric charges between particles can be achieved by utilizing the mutual action obtained when these compound (A) and compound (B) are used in combination.

In the toner according to the present invention, in order to attain a much higher effect when the compound (A) and compound (B) are used in combination, it is preferred to satisfy at least one of the following conditions.

(1) The metal atoms in metal complexes of the compound (A) and compound (B) used in combination may preferably be the same so that both the compounds can have substantially the same compatibility with the resin.

(2) The metal atom in each metal complex may preferably be Cr so that the toner can have a higher chargeability.

(3) The compound (A) and compound (B) may each preferably have a smaller particle size so that their dispersibility to the resin can be improved. As a specific value, they may each preferably have a volume average particle diameter ($\bar{d}_v$) of nor more than 9.0 μm and a number average particle diameter ($\bar{d}_n$) of not more than 5.0 μm.

(4) The compound (A) and compound (B) may preferably have substantially the same electrical resistance. Stated specifically, the ratio of volume resistivity of the compound (A) to that of the compound (B) may preferably be $10^{-3}$ to $10^3$ so that the triboelectric charges can be made uniform.

Metal complexes preferably used as the above compound (A) are specifically those of a salicylic acid type or naphthoic acid type represented by the following formula (I), (II) or (III).

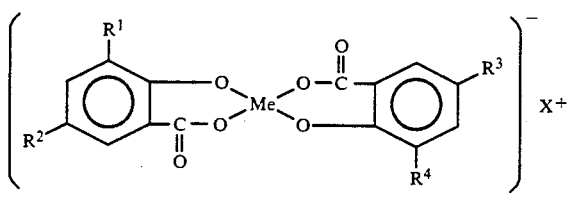

(I)

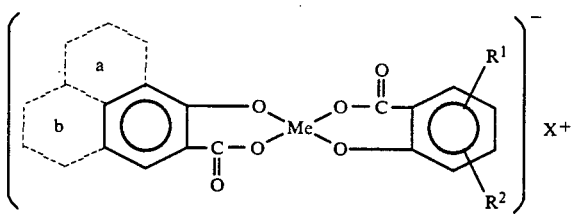

(II)

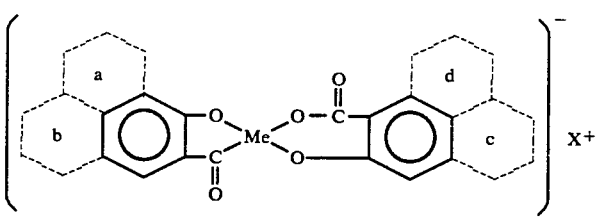

(III)

In the above formulas (I) and (II), $R^1$ to $R^4$ may be the same or different from each other, and each represent a hydrogen atom or a hydrocarbon group such as an alkyl group or alkenyl group, having 1 to 10 carbon atoms, provided that in the formula (I) at least one of $R^1$ to $R^4$ represent(s) the hydrocarbon group defined above. In the formulas (II) and (III), one of a and b is a benzene ring or a cyclohexene ring and the other is absent or selected from the group consisting of an alkyl group having 4 to 9 carbon atoms, a benzene ring and a cyclohexene ring; and also one of b and c is a benzene ring or a cyclohexene ring and the other is absent or selected from the group consisting of an alkyl group having 4 to 9 carbon atoms, a benzene ring and a cyclohexene ring Me represent a metal atom such as Cr, Ni, Co, Cu or Zn.

$X^+$ represents a counter ion such as $H^+$, $K^+$, $Na^+$, $NH_4$ or $Li^+$.

In the salicylic acid or naphthoic type metal complex represented by any of the formulas (I) to (III), an alkyl group having 1 to 5 carbon atoms can be readily introduced as the alkyl group represented by $R^1$, $R^2$, $R^3$ and $R^4$. A tertiary butyl group, a tertiary amyl group or an alkyl group having less carbon atoms is preferably used. In the present invention, particularly preferably used are a 3,5-di-tert-butyl-salicylic acid complex compound and a chromium mono-tert-butyl-salicylate complex compound.

As shown also in the above formulas, in the metal complex compound (A), the ligands attached to the metal atom need not be the same. In this instance, at least one ligand of these ligands may be the ligand of the aromatic hydroxycarboxylic acid having the lipophilic group.

To describe more specifically, the complex compounds with the following structures are particularly preferably used as the metal complex compound (A).

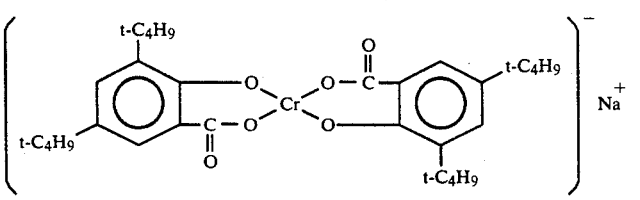

A-1

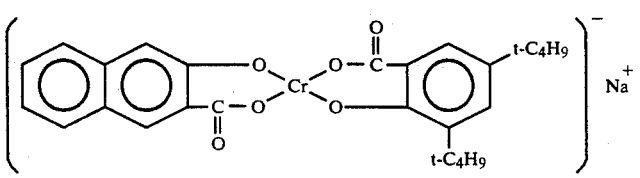

A-2

As for the metal complex type monoazo dye (B) having the hydrophilic group, it is possible to suitably use metal complex type monoazo dyes known as charge control agents for negative toners.

As this monoazo dye, preferably used are metal complex type monoazo dyes having as a ligand a product produced by coupling with a phenol or naphthol derivative, represented by the following structural formulas.

(IV)

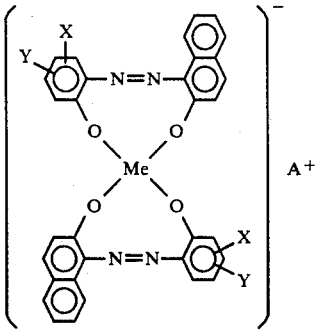

(V)

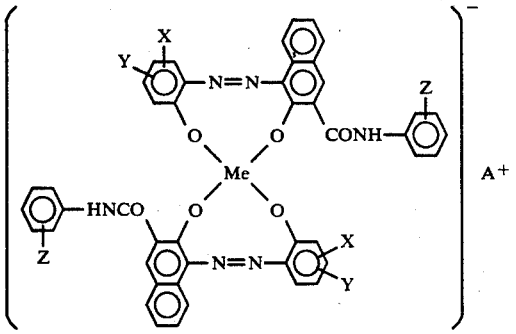

In the formulas, Me represents a metal atom such as Cr, Ni, Co, Cu, Zn or Fe. $A^+$ represents a counter ion such as $H^+$, $K^+$, $Na^+$, $HN_4^+$ or $Li^+$. At least one of X, Y and Z represent(s) a hydrophilic group, and any other(s) represent(s) a hydrogen atom or a hydrocarbon group having 1 to 10 carbon atoms.

Herein the hydrophilic group refers to a group of polar atoms having a strong mutual action with water. A main hydrophilic group may include $—SO_3H$, $—SO_3M$, —COOM, $—NR_3X$, —COOH, $—NH_2$, —CN, —OH, $—NHCONH_2$, —X, and $—NO_2$, wherein R is an alkyl group, M is an alkali metal or $—NH_4$. In the present invention, what is preferably used as the hydrophilic group is halogen (—X), carboxyl (—COOH), hydroxyl (—OH), nitro ($—NO_2$), sulfo ($—SO_3H$) or sulfoamino ($—SO_3NH_4$).

The monoazo dye (B) having such a hydrophilic group may preferably have a benzene ring or naphthalene ring in its ligand, and may preferably have a structure of O,O'-dioxyazo type.

The lipophilic group or hydrophilic group described above may preferably be directly bonded to a monocyclic or polycyclic hydrocarbon group in the structure, as exemplified by a benzene ring or naphthalene ring.

In order to well achieve the effect of adding the above metal complex compounds to the toner, the metal atom in each metal complex may preferably be Cr so that the toner can have a higher chargeability.

Complex compounds particularly preferably used as the metal complex compound (B) are specifically those having the following structures.

B-1

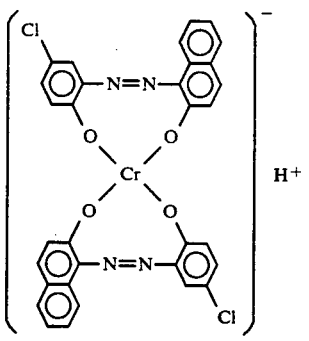

B-2

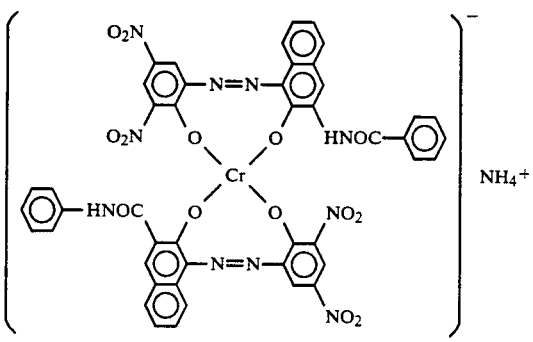

B-3

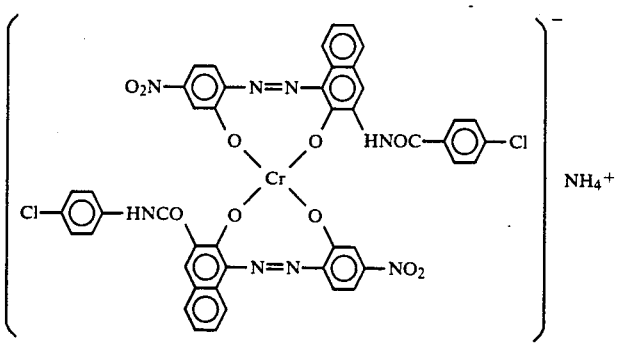

The proportion of the compounds (A) and (B) added to the binder resin may preferably be compound (A)/compound (B)=1/10 to 10.0, and more preferably compound (A)/compound (B)=$\frac{1}{3}$ to 3.0.

Each of the compounds (A) and (B) may preferably be added in an amount of 0.1 part to 10.0 parts, and more preferably 0.5 part to 4.0 parts, based on 100 parts of the the binder resin.

To the developer used in the present invention, other additives may further be added so long as there are substantially no ill influences. For example, it is possible to add a lubricant such as Teflon powder or zinc stearate powder; a fixing aid exemplified by a low-molecular weight polyalkylene such as low-molecular weight polyethylene or low-molecular weight polypropylene; and as a conductivity-providing agent, a metal oxide such as tin oxide, and strontium titanate.

The low-molecular weight polyalkylene used in the toner contained in the developer according to the present invention may preferably have a molecular weight distribution with plural peaks. More specifically, it is desirable that its chromatogram obtained by gel permeation chromatography has at least two peaks, that is, p(1) present in the molecular weight range of from 2,000 to 80,000, and also has at least one additional peak (P2) in the lower molecular weight area than the main peak. The additional maximum value may preferably be at the position of 1/30 to 1/5, and more preferably 1/20 to 1/10, of the molecular weight of the main maximum value. Addition of the polyalkylene having the molecular weight distribution as described above can bring about an improvement in the compatibility with the binder resin and also an additional improvement in the dispersibility of toner additives, so that a uniform chargeability of the developer can be achieved. Moreover, its incorporation into the toner in combination with the above-described two types of charge control agents added to the toner according to the present invention is preferred since it is very effective for improving the chargeability of the developer.

The low-molecular weight polyalkylene should be used in an amount of 0.1 part by weight to 10 parts by weight based on 100 parts by weight of the binder resin.

The low-molecular weight polyalkylene used in the present invention may preferably be a propyleneethylene copolymer, and more preferably be the one in which the ethylene units are contained in an amount of 1% by weight to 10% by weight of the low-molecular weight polyalkylene.

The toner used in the present invention may preferably have a weight-based, weight average particle diameter $D_4$ of 5 μm to 15 μm, more preferably 10 μm to 15 μm, and still more preferably 10 μm to 13.5 μm, a fine-powder content (particle diameter in number distribution: 6.35 μm or smaller) of not more than 30% by number, and more preferably not more than 25% by number, and a coarse-powder content (particle diameter in weight distribution: 20.2 μm or larger) of not more than 4% by weight, and more preferably not more than 2% by weight. At the same time, the toner used in the present invention may preferably have its MI value of 0.01 to 10, and more preferably 0.01 to 6.

The MI (melt index) value in the present invention refers to a value measured according to JIS K-7210 under conditions of a temperature of 125° C. and a pressure of 10 kg.

The particle size distribution can be measured by various methods. In the present invention, it is measured using a Coulter counter.

A Coulter counter Type TA-II (manufactured by Coulter Electronics, Inc.) is used as a measuring device. An interface (manufactured by Nikkaki) that outputs number distribution and volume distribution and a personal computer CX-1 (manufactured by Canon Inc.) are connected. As an electrolytic solution, an aqueous 1% NaCl solution is prepared using first-grade sodium chloride. Measurement is carried out by adding as a dispersant 0.1 ml to 5 ml of a surface active agent, preferably an alkylbenzene sulfonate, to 100 ml to 150 ml of the above aqueous electrolytic solution, and further adding 2 mg to 20 mg of a sample to be measured. The electrolytic solution containing the sample is subjected to dispersion for about 1 minute to about 3 minutes in an ultrasonic dispersion machine. The volume distribution and number distribution of particles of 2 μm to 40 μm are calculated by measuring the volume and number of toner particles by means of the above Coulter counter Type TA-II, using an aperture of 100μ as its aperture. Then the values according to the present invention are determined, which are the weight-based, weight average particle diameter $D_4$ determined from the volume distribution (where the middle value of each channel is used as the representative value for each channel), the weight based, coarse-powder content (20.2 μm or larger) determined from the volume distribution, and the number based, fine-powder number (6.35 μm or smaller).

The toner of the present invention can be produced by various methods including a method in which component materials are well kneaded using a heat kneader such as a heat roll or an extruder followed by mechanical crushing and classification to give a toner; a method in which materials are dispersed in a binder resin solution followed by spray drying to give a toner; and a method of producing a toner by polymerization in which given materials are mixed into monomers that constitute a binder resin, to give an emulsified suspension followed by polymerization to give the toner.

The image forming apparatus according to the present invention will be described below with reference to FIG. 6.

The surface of an OPC photosensitive member is negatively charged by the operation of a primary corona assembly 217, and a digital latent image is formed by image scanning through exposure 705 carried out using a laser beam. The latent image thus formed is reversely developed using a one-component magnetic developer 5 held in a developing assembly 211 equipped with a magnetic blade 6 and a developing sleeve 2 provided in its inside with a magnet and also covered with a resin coating layer containing the conductive fine particles and/or solid lubricant and having $C_{v5}$ of not more than 5 μm. In a developing zone, an AC bias, a pulse bias and/or a DC bias is/are applied across a conductive substrate of a photosensitive drum 1 and the developing sleeve 2 through a bias applying means 712. A transfer paper P is fed and delivered to a transfer zone, where the transfer paper P is charged by means of a voltage applying means from its back surface (the surface opposite to the photosensitive drum) through a transfer means 702, so that the developed image (toner image) on the surface of the photosensitive drum is electrostatically transferred to the transfer paper P. The transfer paper P separated from the photosensitive drum 1 is subjected to fixing using a heat-pressure roller fixing unit (thermal platen 707 so that the toner image on the transfer paper can be fixed.

The one-component developer remaining on the photosensitive drum 1 after the transfer step is removed by the operation of a cleaning assembly 708 having a cleaning blade. After the cleaning, the residual charges on the photosensitive drum 1 is eliminated by erase exposure 706, and thus the procedure again starting from the charging step using the primary corona assembly 217 is repeated.

An electrostatic latent image bearing member (the photosensitive drum) comprises a photosensitive layer and a conductive substrate, and is rotated in the direction of the arrow. In the developing zone, the developing sleeve 2, a non-magnetic cylinder, which is a toner supporting member, is rotated in the counter direction of the electrostatic latent image bearing member. In the inside of the non-magnetic cylindrical developing sleeve 2, a multi-polar permanent magnet (magnet roll) serving as a magnetic field generating means is fixed not torotate. The one-component insulative magnetic developer 5 held in a developer container 212 of the developing assembly 211 is coated on the surface of the non-magnetic cylindrical developing sleeve 2, and, for example, minus triboelectric charges are imparted to toner particles because of the friction between the surface of the sleeve 2 and the toner particles. A doctor blade 6 made of iron is disposed opposingly to one of the magnetic pole positions of the multi-polar permanent magnet, in proximity (with a space of 50 μm to 500 μm) to the surface of the cylinder. Thus, the thickness of a developer layer can be controlled to be small (from 30 μm to 300 μm) and uniform so that a developer layer smaller in thickness than the gap between the photosensitive drum 1 and developing sleeve 2 in the developing zone can be formed on the sleeve 2 not to contact with the photosensitive drum 1. The rotational speed of this developing sleeve 2 may preferably be regulated so that the peripheral speed of the sleeve can be substantially equal or close to the speed of the peripheral speed of the surface on which electrostatic images are retained. As the magnetic doctor blade 6, a permanent magnet may be used in place of iron to form an opposing magnetic pole. In the developing zone, the AC bias or pulse bias may be applied through the bias means 712, across the developing sleeve 2 and the surface on which electrostatic images are retained. This AC bias may have a frequency of 200 Hz to 4,000 Hz, and a Vpp of 500 V to 3,000 V.

When the toner particles are brought in the developing zone, the toner particles are transfered on the electrostatic image by the electrostatic force of the electrostatic image retaining surface and the action of the AC bias or pulse bias.

In place of the magnetic doctor blade 6, an elastic blade formed of an elastic material such as silicone rubber may be used so that the layer thickness of the developer layer can be controlled by pressure and the toner can be thereby coated on a developer carrying member.

Figure 7:
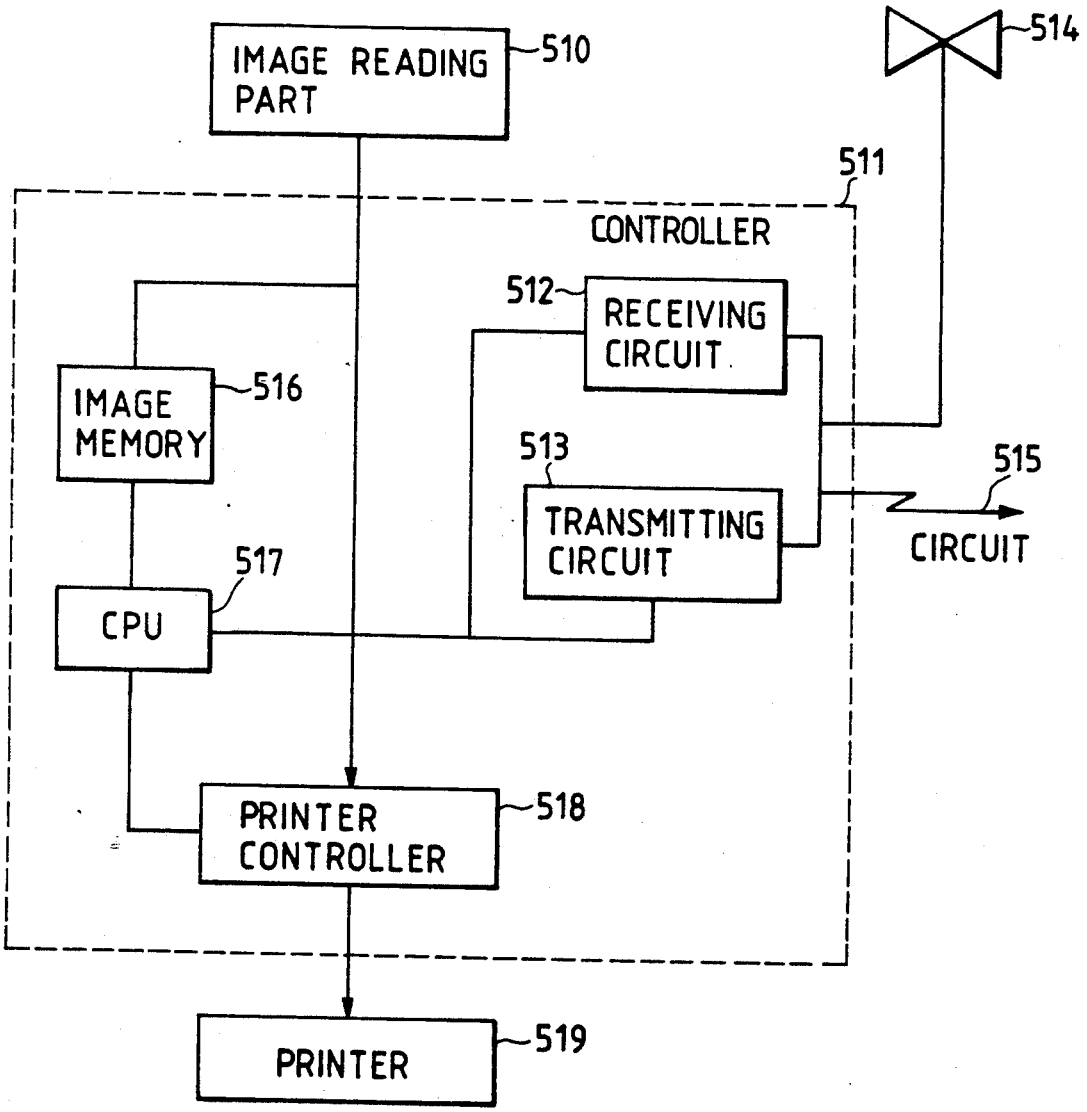
FIG. 7 is a block diagram to show an example of a facsimile apparatus or system.

When the image forming apparatus of the present invention is used as a printer of a facsimile machine, optical image exposing light L serves as exposing light used for the printing of received data. FIG. 7 illustrates an example thereof in the form of a block diagram.

A controller 511 controls an image reading part 510 and a printer 519. The whole of the controller 511 is controlled by CPU 517. Image data output from the image reading part is sent to the other facsimile station through a transmitting circuit 513. Data received from the other station is sent to a printer 519 through a receiving circuit 512. Given image data are stored in an image memory 516. A printer controller 518 controls the printer 519. The numeral 514 denotes a telephone.

An image received from a line 515 (image information from a remote terminal connected through the line) is demodulated in the receiving circuit 512, and then successively stored in an image memory 516 after the image information is decoded by the CPU 517. Then, when images for at least one page have been stored in the memory 516, the image recording for that page is carried out. The CPU 517 reads out the image information for one page from the memory 516 and sends the coded image information for one page to the printer controller 518. The printer controller 518, having received the image information for one page from the CPU 517, controls the printer 519 so that the image information for on page is recorded.

The CPU 517 receives image information for next page in the course of the recording by the printer 519.

Images are thus received and recorded.

The electrophotographic apparatus may be constituted of a combination of plural components put together as one apparatus unit from among the constituents such as the above photosensitive drum, developing assembly and cleaning means so that the unit can be freely mounted on or detached from the body of the apparatus. For example, at least one of the charging means, developing assembly and cleaning means may be integrally supported together with the photosensitive drum to form one unit that can be freely mounted on or detached from the body of the apparatus, and the unit can be freely mounted or detached using a guide means such as a rail provided in the body of the apparatus. Here, the above apparatus unit may be so constituted as to be put together with the charging means and/or the developing assembly.

The present invention will be specifically described below by giving Examples. The present invention is by no means limited to the following Examples. In all Examples, the "part(s)" means part(s) by weight.

EXAMPLE 1

| | |
|---|---|
| Styrene/methyl acrylate copolymer (copolymerization weight ratio: 8:2; weight average molecular weight: 250,000) | 100 parts |
| Magnetite | 60 parts |

-continued

| | |
|---|---|
| (average particle diameter: 0.2 μm) | |
| Monoazo type chromium complex | 4 parts |
| Low-molecular weight polypropylene | 3 parts |

The above materials were uniformly mixed, followed by kneading, pulverization and classification to give a negatively chargeable insulative magnetic toner with a weight average particle diameter of about 12 μm.

As a colloidal fine silica powder, 100 parts of a fine silica powder with a BET specific surface area of 200 $m^2/g$ (Aerosil #200; available from Japan Aerosil Co.) was treated with 20 parts of hexamethyldisilazane (HMDS), and thereafter treated with a solution prepared by diluting 10 parts of dimeth one oil (KF-96, 100 cS; available from Shin-Etsu Chemical Co., Ltd.) in a solvent (normal hexane). After drying, a heat treatment at about 250° C. was carried out to give a negatively chargeable hydrophobic fine silica powder having been treated with hexamethyldisilazane and dimethylsilicone oil. Then, 0.6 part of the resulting negatively chargeable hydrophobic fine silica powder and 100 parts of the toner previously obtained were blended to give a developer.

Next, a commercially available laser beam printer LBP-SX (manufactured by Canon, Inc.) was modified, and the surface of a developing sleeve (the developer carrying member) thereof was coated with a composition prepared according to Formulation Example 2 previously described (i.e., conductive graphite particles are contained in phenol resin in a proportion of 1:1) (coating layer thickness: 8 μm; volume resistivity: 10 to $10^3$ Ω.cm), and the surface thus coated, was polished by the felt brought into contact as previously described, to obtain a coated sleeve having a $C_{v5}$ of 1.0 μm and an Ra of 1.7 μm was thus prepared. This was set in the apparatus unit to make up an image reproducing machine.

As the developing bias, an AC bias with Vpp of 1,600 V and a frequency of 1,800 Hz was used. The gap between the coated developing sleeve serving as the developer carrying member and the photosensitive drum serving as the electrostatic latent image bearing member was set to be about 300 microns.

The above developer was loaded in the above evaluation test machine to continuously reproduce images on 3,000 sheets in an environment of normal temperature and normal humidity (23° C., 60%RH) according to the developing method in which electrostatic latent images with negative polarity were reverse-developed using the magnetic toner having negative triboelectric charges. As a result, fading-free, uniform images with an image density of 1.33 were obtained. The same test was carried out in an environment of high temperature and high humidity (32.5° C., 85%RH). As a result, similarly good results were obtained.

Comparative Example 1

Figure 2:
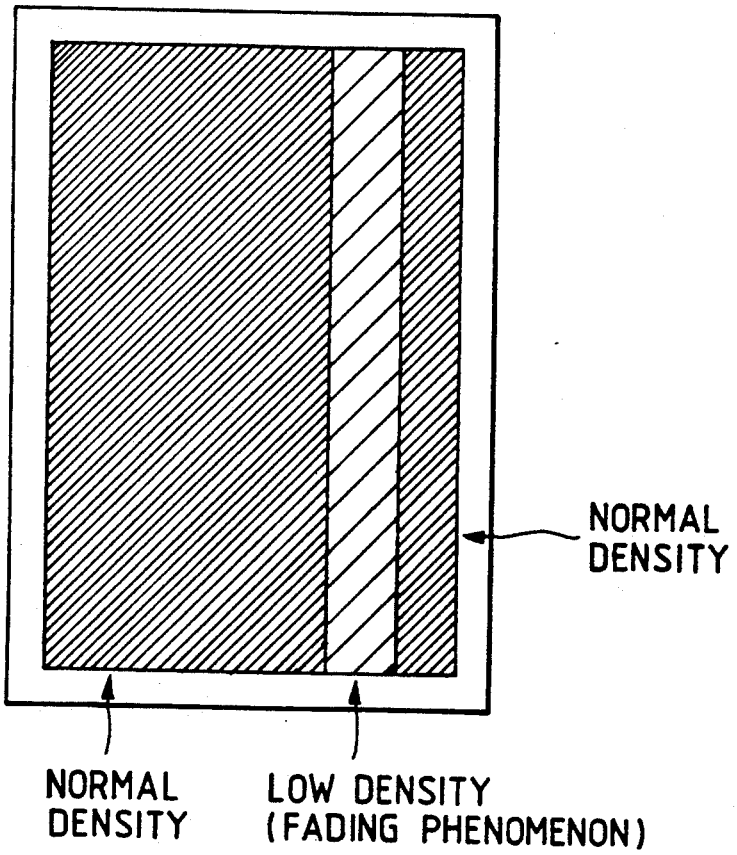
FIG. 2 illustrates a toner image, for describing the phenomenon of fading.

Using a developing sleeve having a $C_{v5}$ of 10 μm and an Ra of 2.5 μm, prepared as in Example 1 except the surface polishing, images were continuously reproduced in the same manner as in Example 1. The fading as shown in FIG. 2 occurred, giving a dense area with an image density of 1.30 and a faded area with an image density of 1.0.

Comparative Example 2

Using a hydrophobic fine silica powder treated with demthyldichlorosilane and also using a developing sleeve having a $C_{v5}$ of 10 μm and an Ra of 2.5 μm, prepared as in Example 1 but not with the surface polishing, images were continuously reproduced in the same manner as in Example 1. The fading occurred, giving an area with an image density of 1.25 and an area with a low image density of 0.9.

EXAMPLE 2

A developer was obtained in the same manner as in Example 1 except that 100 parts of a fine silica powder with a BET specific surface area of 200 $m^2/g$ (Aerosil #200; available from Japan Aerosil Co.) was treated with 20 parts of dimethylsilicone oil (KF-96, 100 cS) diluted with a solvent, died and heated at about 280° C. to give a fine silica powder pretreated with dimethylsilicone oil. Images were reproduced and evaluated in the same manner as in Example 1. Good results were obtained until 3,000 sheet reproduction in an environment of normal temperature and normal humidity and until 2,000 sheet reproduction in an environment of high temperature and high humidity.

EXAMPLE 3

The fine silica powder in Example 2 was replaced with α-alumina (average particle diameter: 0.020μ; BET specific surface area: 100 $m^2/g$) and the same treatment was carried out. Thereafter, a developer was obtained in the same manner as in Example 1.

As for the evaluation test machine, the degree of the surface polishing carried out in Example 1 was changed to give a developing sleeve having a $C_{v5}$ of 0.6 μm and an Ra of 0.5 μm, which was set in the machine, and also the above developer was loaded therein to carry out the same tests as in Example 1. Although images had slightly low reflection density as a whole, fading-free, good images were obtained until 2,000 sheet reproduction in an environment of normal temperature and normal humidity and until 1,000 sheet reproduction in an environment of high temperature and high humidity.

EXAMPLE 4

A developer was obtained in the same manner as in Example 1 except that 100 parts of a fine silica powder with a BET specific surface area of 130 $m^2/g$ (Aerosil #130; available from Japan Aerosil Co.) was treated with 30 parts of dimethylsilicone oil (KF-96, 100 cS) diluted with a solvent, and dried and heated at about 280° C. to give a fine silica powder pretreated with dimethylsilicone oil.

As for the evaluation test machine, the degree of the surface polishing in Example 1 was changed to give a developing sleeve having a $C_{v5}$ of 2.5 μm and an Ra of 1.8 μm, which was set in the machine, and also the above developer was loaded therein to carry out the same tests as in Example 1. Although some images showed slight fading on the level not mattering in practical use, good results were obtained until 3,000 sheet reproduction in an environment of normal temperature and normal humidity and until 2,000 sheet reproduction in an environment of high temperature and high humidity.

EXAMPLE 5

A developer was obtained in the same manner as in Example 4 except that 100 parts of a fine silica powder with a BET specific surface area of 300 $m^2/g$ (Aerosil #300; available from Japan Aerosil Co.) was treated with 2 parts of fluorine-modified silicone oil. Images were reproduced in the same manner as in Example 4. Although slight fading occurred, good results were obtained until 2,000 sheet reproduction in an environment of normal temperature and normal humidity and until 1,000 sheet reproduction in an environment of high temperature and high humidity.

EXAMPLE 6

Figure 6:
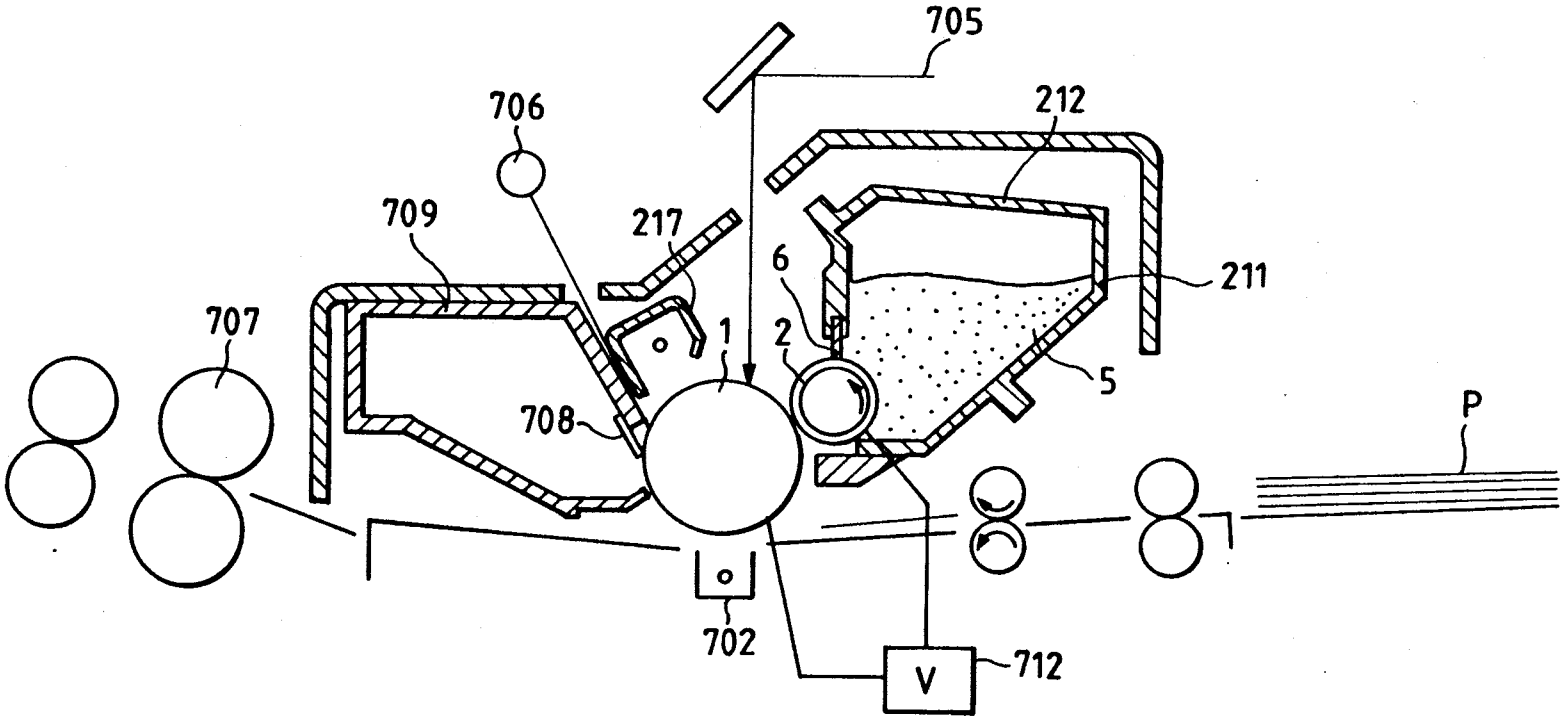
FIG. 6 schematically illustrates an example of an image forming apparatus having the apparatus unit of the present invention.

The developer prepared in Example 4 was fed to the image forming apparatus as shown in FIG. 6 to carry out image reproduction tests in the same manner as in Example 1. Good results were obtained in environments of both the normal temperature and normal humidity and the high temperature and high humidity.

Images were reproduced under the following conditions:.

(a) The surface of a developing sleeve made of aluminum, used in a laser beam printer (LBP-SX) was coated (layer thickness: about 6 μm) with a composition comprised of 9 parts of graphite particles (volume average particle diameter: 5 μm), 1 part of conductive fine carbon particles and 10 parts of phenol resin. After the polishing with the felt a coated sleeve having a $C_{v5}$ of 0.9 μm and an Ra of 1.5 μm was thus prepared, and was used as the developer carrying member 2.

(b) A laminate type OPC photosensitive drum of 30 mm in diameter was used as the electrostatic latent image bearing member 1.

(c) A blade made of iron was used as the blade 6, and the gap between the coated sleeve and the iron blade was set to be about 250 μm.

(d) The nearest space between the coated sleeve and the OPC photosensitive drum in the developing zone was set to be about 300 μm.

(e) As the developing bias, an AC bias (Vpp: 1,600 V; frequency: 1,800 Hz) and a DC bias of −400 V were applied to the coated sleeve.

(f) The electrostatic latent image was developed by reverse development.

(g) Other conditions were set to be the same conditions for image reproduction as in the laser beam printer (LBP-SX).

As described above, the occurrence of fading can be prevented not only in an environment of normal temperature and normal humidity but also in an environment of high temperature and high humidity, when the developer according to the present invention is used in the image forming apparatus having a developing apparatus in which the developer-carrying member has the surface layer of a resin containing at least conductive fine particles and/or a solid lubricant, the surface layer having in its relative load curve (Abbot's load curve) a cutting depth $C_v$ of not more than 5 μm when a relative load length $t_p$ is 5%.

Synthesis Example 1

First, 200 parts of cumene was put in a reaction vessel and heated to the reflux temperature. In this cumene, 85 parts of styrene monomer, 15 parts of acrylic acid monomer and 8.5 parts of di-tert-butyl peroxide were mixed. Under further reflux of cumene (146° C. to 156° C.), solution polymerization was completed, and then the temperature was raised to remove the cumene. The resulting styrene/acrylic acid copolymer was soluble in THF, and had an Mw of 3,500, an Mw/Mn of 2.52, a main peak at a molecular weight of 3,300 in the chart of GPC and a Tg of 56° C.

Next, 30 parts of the above copolymer was dissolved in the following monomer mixture to give a mixed solution.

| Monomer mixture | Mixing proportion |
|---|---|
| Styrene monomer | 50 parts |
| n-Butyl acrylate monomer | 17 parts |
| Acrylic acid monomer | 3 parts |
| Divinyl benzene | 0.26 part |
| Benzoyl peroxide | 1 part |
| tert-Butyl-peroxy-2-ethylhexanoate | 0.7 part |

In the above mixed solution, 170 parts by weight of water containing 0.1 part by weight of partially saponified polyvinyl alcohol was added to give a suspension dispersion. This dispersion was added in a reaction vessel containing 15 parts by weight of water and substituted with nitrogen, and suspension polymerization was carried out at the reaction temperatures of from 70° to 95° C. for 6 hours. After the completion of the reaction, the reaction mixture was filtered, dehydrated and dried to give a resin composition of copolymers. This composition was a uniform mixture of a styrene/acrylic acid copolymer and a styrene/acrylic acid/n-butyl acrylate copolymer. The molecular weight distribution of the THF-soluble matter was measured to reveal that it had peaks at molecular weights of about 3,500 and about 31,000, respectively, and had an Mn of 5,100, an Mw of 115,000 and an Mw/Mn of 22.5. The component with the molecular weight of not more than 10,000 was in an amount of 27% by weight. It was also confirmed that the Tg of the resin composition was 59° C. and the glass transition point $Tg_1$ of the component with a molecular weight of not more than 10,000, fractionated by GPC, was 57° C.

This copolymer had an acid value of 22.0.

Synthesis Example 2

First, 200 parts of cumene was put in a reaction vessel and heated to the reflux temperature. To this cumene, a mixture of 78 parts of styrene monomer, 15 parts of n-butyl acrylate monomer, 7 parts of maleic acid n-butyl half ester, 0.3 part of divinyl benzene and 1.0 part of di-tert-butyl peroxide was dropwise added over a period of 4 hours under reflux of cumene to carry out polymerization for further 4 hours. Thereafter, the solvent was removed by conventional distillation under reduced pressure to give a copolymer. The resulting copolymer had an Mw of 350,000, an Mw/Mn of 11.0 and a Tg of 60° C.

This copolymer had an acid value of 18.5.

Synthesis Example 3

First, 200 parts of cumene was put in a reaction vessel and heated to the reflux temperature. The following mixture was subjected to solution polymerization under reflux of cumene. After the completion of reaction, temperature was raised to remove cumene.

| Monomer mixture | Mixing proportion |
|---|---|
| Styrene monomer | 90 parts |
| Maleic acid n-butyl half ester monomer | 10 parts |
| Di-tert-butyl peroxide | 8.5 parts |

The resulting copolymer had an Mw of 6,900, an Mw/Mn of 2.36, a main peak at a molecular weight of 7,200, and a Tg of 64° C.

Next, 30 parts of the above styrene/maleic acid n-butyl half ester copolymer was dissolved in the following monomer mixture to give a mixture.

| Monomer mixture | Mixing proportion |
|---|---|
| Styrene monomer | 45 parts |
| n-Butyl acrylate monomer | 20 parts |
| Maleic acid n-butyl half ester monomer | 5 parts |
| Divinyl benzene | 0.25 part |
| Benzoyl peroxide | 0.65 part |
| tert-Butyl-peroxy-2-ethylhexanoate | 0.85 part |

The reaction was carried out in the same manner as in Synthesis Example 1 to give a composition of a styrene/maleic acid n-butyl half ester copolymer and a styrene/n-butyl acrylate/maleic acid n-butyl half ester copolymer.

This copolymer had an acid value of 20.6.

Synthesis Example 4

Synthesis Example 3 was repeated except that the styrene monomer was used in an amount of 82 parts, and the maleic acid n-butyl half ester, 3 parts.

The resulting copolymer had an acid value of 7.3.

Preparation Example 1

| | |
|---|---|
| Resin composition of Synthesis Example 1 | 100 parts |
| Magnetic material fine powder (BET specific surface area: 8.6 $m^2/g$) | 60 parts |
| Negative charge control agent (monoazo dye chromium complex) | 1 part |
| Low-molecular weight polypropylene (Mw: 6,000) | 3 parts |

The above materials were melt-kneaded using a twin extruder heated to 140° C. The kneaded product was cooled and crushed by a hammer mill, and the crushed product was pulverized using a jet mill. The resulting finely pulverized product was air-classified to give a negatively chargeable magnetic toner (classified powder) with a weight average particle diameter of 12 μm. Then, 0.6 part of a hydrophobic colloidal fine silica powder pretreated with dimethylsilicone oil, and 100 parts of the above magnetic toner were blended using a Henschel mixer to give developer (I).

Preparation Example 2

| | |
|---|---|
| Resin composition of Synthesis Example 2 | 100 parts |
| Magnetic material fine powder (BET specific surface area: 8.6 $m^2/g$) | 60 parts |
| Negative charge control agent (monoazo dye chromium complex) | 1 part |
| Low-molecular weight polypropylene (Mw: 6,000) | 3 parts |

Using a mixture of the above materials, Preparation Example 1 was repeated to give a magnetic toner, and, in the same manner as in Preparation Example 1, a hydrophobic colloidal fine silica powder pretreated with dimethylsilicone oil was added to the toner, which were then blended using a Henschel mixer to give developer (II).

Preparation Examples 3 and 4

A magnetic toner was obtained in the same manner as in Preparation Example 1 except that the resin composition of Synthesis Example 1 was replaced with the resin compositions of Synthesis Examples 3 and 4, respectively. Then in the same manner as in Example 1 a hydrophobic colloidal fine silica powder pretreated with dimethylsilicone oil was added to the toner, which were then blended to give developers (III) and (IV).

Examples 7 to 11 and Comparative Example 3

A laser beam printer LBP-SX (manufactured by Canon, Inc.) was modified. The surface of (the developer-carrying member) thereof was coated with a composition prepared according to Formulation Example 2 previously described (i.e., conductive graphite particles are contained in phenol resin in a proportion of 1:1) (coating layer thickness: 7.5 μm). The surface thus coated, was polished with the felt as previously described. A coated sleeve thus prepared was set in the printer to make up an image reproducing machine.

As the developing bias, an AC bias with Vpp of 1,600 V and a frequency of 1,800 Hz was used. The gap between the developer-carrying member of the present invention and the photosensitive drum serving as the electrostatic latent image bearing member was set to be about 300 microns.

Next, the developers I to IV of Preparation Examples 1 to 4 were each used in the above evaluation test machine. Actual print tests were carried out in an environment of normal temperature and normal humidity (25° C., 60%RH) and in an environment of high temperature and high humidity (32.5° C. 85%RH) to evaluate printed images.

Ra and $C_{v5}$ values of the developer-carrying members and results of image evaluation are shown in Table 2.

Evaluation on Fading

A: No fading occurs at all.

AB: Slight fading occurs slightly, but not mattering in practical use.

B: Fading is on a low level, but not practically usable.

C: Fading occurs to produce white areas in images.

EXAMPLE 12

| | |
|---|---|
| Styrene/n-butyl acrylate copolymer copolymerization weight ratio: 8:2) | 100 parts |
| Magnetic material fine powder (BET specific surface area: 5.0 $m^2/g$) | 60 parts |
| Charge control agent A (structural formula A-1; $\bar{d}_v$: 6.0 μm; $\bar{d}_n$: 3.2 μm; R: $10^9$ Ω · cm) | 2.0 parts |
| Charge control agent B (structural formula B-1; $\bar{d}_v$: 6.5 μm; $\bar{d}_n$: 4.0 μm; R: $10^{10}$ Ω · cm) | 1.0 part |
| Low-molecular weight polypropylene ($P_1$: 16,000; $P_2$: 950) | 3 parts |

The above materials were melt-kneaded using a twin extruder heated to 140° C., followed by cooling. The kneaded product obtained was crushed using a hammer mill, and the crushed product was pulverized using a jet mill. Then the resulting pulverized product was air-classified to give a negatively chargeable insulative magnetic toner (classified powder) with a weight average particle diameter of 11.7 μm.

To 100 parts of the toner thus obtained, 0.6 part of a hydrophobic colloidal silica (made hydrophobic by 92%) pretreated with dimethylsilicone oil was added, which were then blended under dry conditions using a Henschel mixer to give a developer.

This developer was used in a commercially available laser beam printer LBP-SX (manufactured by Canon, Inc.) modified as follows: The surface of the developer-carrying member was coated with a composition prepared according to Formulation Example 2 previously described (i.e., conductive graphite particles are contained in phenol resin in a proportion of 1:1) (coating layer thickness: 8 μm). The surface thus coated, was polished with the felt as previously described. A coated sleeve having a $C_{v5}$ of 1.09 μm and an Ra of 1.75 μm was thus prepared. Primary charging was effected at −600 V to form a reverse electrostatic latent image. Setting a gap (300 μm) between the photosensitive drum and the developer layer on the developing sleeve (having a magnet in its inside) in an non-contact state, an AC bias (f: 1,800 Hz; Vpp: 1,600 V) and a DC bias ($V_{DC}$: −450 V) were applied to the developing sleeve to convert transfer potential to the reverse polarity. A continuous print test was carried out on 3,000 sheets in an environment of normal temperature and normal humidity (20° C., 60%RH). Fading-free, uniform printed images were obtained. The same test was carried out in an environment of high temperature and high humidity

TABLE 2

| | | Sleeve surface characteristics | | Image evaluation (normal*) | | Image evaluation (high**) | |
|---|---|---|---|---|---|---|---|
| | Developer | Ra (μm) | $C_{v5}$ (μm) | Image density | Fading | Image density | Fading |
| Example: | | | | | | | |
| 7 | I | 1.7 | 1.1 | 1.38 | A | 1.33 | A |
| 8 | II | 1.7 | 1.1 | 1.38 | A | 1.34 | A |
| 9 | I | 1.8 | 2.0 | 1.37 | A | 1.32 | A |
| 10 | III | 2.1 | 3.5 | 1.34 | AB | 1.31 | AB |
| 11 | IV | 0.6 | 0.5 | 1.30 | A | 1.28 | A |
| Comparative Example: | | | | | | | |
| 3 | I | 10 | 2.5 | 1.25 | C | 1.20 | C |

*normal temperature and normal humidity

**high temperature and high humidity (32.5° C., 85%RH). As a result, similarly good results were obtained.

EXAMPLE 13

| | |
|---|---|
| Styrene/2-ethylhexyl acrylate copolymer (copolymerization weight ratio: 8:2) | 100 parts |
| Magnetic material fine powder (BET specific surface area: 7.5 $m^2/g$) | 60 parts |
| Charge control agent A (structural formula A-2; $\bar{d}_v$: 6.0 μm; $\bar{d}_n$: 3.4 μm; R: $10^9$ Ω · cm) | 1.0 part |
| Charge control agent B (structural formula B-2; $\bar{d}_v$: 5.6 μm; $\bar{d}_n$: 4.0 μm; R: $10^{10}$ Ω · cm) | 3.0 parts |
| Low-molecular weight polypropylene ($P_1$: 16,000; $P_2$: 950) | 3 parts |

The above materials were melt-kneaded, followed by steps of pulverization and classification to give a negatively chargeable magnetic toner with an average particle diameter of 11.3 μm.

Using the above toner, a developer was prepared in the same manner as in Example 12, and print tests were also carried out in the same manner as in Example 12. As a result, fading-free, good printed images were obtained until 3,000 sheet reproduction in an environment of normal temperature and normal humidity and until 2,000 sheet reproduction in an environment of high temperature and high humidity.

EXAMPLE 14

Tests were carried out in the same manner as in Example 12 except for using a developer-carrying member wherein the degree of surface polishing on the developer-carrying member of Example 12 was changed to give a $C_{v5}$ of 0.51 μm and an Ra of 0.55 μm. Although images had a little low reflection density as a whole, fading-free, good printed images were obtained until 3,000 sheet reproduction in an environment of normal temperature and normal humidity and until 2,000 sheet reproduction in an environment of high temperature and high humidity.

EXAMPLE 15

Tests were carried out in the same manner as in Example 12 except for using a developer-carrying member wherein the degree of surface polishing on the developer-carrying member of Example 12 was changed to give a $C_{v5}$ of 2.30 μm and an Ra of 1.81 μm. Although some printed images showed slight fading on the level not mattering in practical use, good results were obtained until 3,000 sheet reproduction in an environment of normal temperature and normal humidity and until 2,000 sheet reproduction in an environment of high temperature and high humidity.

EXAMPLE 16

Tests were carried out in the same manner as in Example 13 except for using a developer-carrying member wherein the degree of surface polishing of the developer-carrying member of Example 13 was changed to give a $C_{v5}$ of 4.79 μm and an Ra of 2.33 μm. Although images had a little low reflection density as a whole and showed slight fading on the level not mattering in practical use, good printed images not mattering in practical use were obtained until 2,000 sheet reproduction in an environment of normal temperature and normal humidity and until 1,000 sheet reproduction in an environment of high temperature and high humidity.

EXAMPLE 17

| | |
|---|---|
| Styrene/methyl acrylate copolymer (copolymerization weight ratio: 8:2; weight average molecular weight: 250,000) | 100 parts |
| Magnetic material (average particle diameter: 0.2 μm) | 60 parts |
| Monoazo dye | 2 parts |
| Low-molecular weight polypropylene | 3 parts |

The above materials were uniformly mixed, and kneaded for 20 minutes using a two-roll mill heated to 150° C. The kneaded product was cooled and thereafter crushed, followed by pulverization with a fine grinding mill making use of jet streams, and then classification with an air classifier to give a black fine powder (a negatively chargeable magnetic toner) with a weight average particle diameter of 11.6 μm, a fine-powder content (6.35 μm or smaller) of 16.0% by number and a course-powder content (20.2 μm or larger) of 0.4% by weight. The MI of this negatively chargeable magnetic toner was 0.8

Next, 100 parts of a fine silica powder with a BET specific surface area of 200 $m^2/g$ (Aerosil #200; available from Japan Aerosil Co.) was treated with 20 parts of hexamethyldisilazane (HMDS), and thereafter treated with 10 parts of dimethylsilicone oil (KF-96, 100 cS; available from Shin-Etsu Chemical Co., Ltd.) dilute with a solvent. After drying, a heat treatment at about 250° C. was carried out to give a negatively chargeable hydrophobic fine silica powder pretreated with hexamethyldisilazane and dimethylsilicone oil. Then, 0.6 part of the negatively chargeable hydrophobic fine silica powder was externally added to 100 parts of the toner previously obtained to give a developer.

Next, a laser beam printer LBP-SX (manufactured by Canon, Inc.) was modified. The surface of a developing sleeve (the developer-carrying member) thereof was coated with a composition prepared according to Formulation Example 2 previously described (i.e., conductive graphite particles are contained in phenol resin in a proportion of 1:1) (coating layer thickness: 8 μm). The surface thus coated, was polished with the felt as previously described. A coated sleeve having a $C_{v5}$ of 1.0 μm and an Ra of 1.7 μm was thus prepared. This was set in the apparatus unit to make up an image reproducing machine.

As the developing bias, an AC bias with Vpp of 1,600 V and a frequency of 1,800 Hz was used. The space between the developer-carrying member and the electrostatic latent image bearing member was set to be about 300 microns.

The above developer was loaded in the above printer to continuously reproduce images on 3,000 sheets in an environment of normal temperature and normal humidity (23° C., 60%RH). As a result, fading-free, uniform images were obtained. The same test was carried out in an environment of high temperature and high humidity (32.5° C., 85%RH). As a result, similarly good results were obtained.

EXAMPLE 18

Images were reproduced under the same conditions as in Example 17 except for using a toner with a weight average particle diameter of 10.3 μm, a fine-powder content (6.35 μm or smaller) of 24.8% by number, a course-powder content (20.2 μm or larger) of 0.5% by weight and an MI of 2. As a result, good images were obtained until 3,000 sheet reproduction in an environment of normal temperature and normal humidity, and until 2,000 sheet reproduction even in an environment of high temperature and high humidity.

EXAMPLE 19

Images were reproduced under the same conditions as in Example 17 except for using a toner with a weight average particle diameter of 13.4 μm, a fine-powder content (6.35 μm or smaller) of 12.4% by number, a course-powder content (20.2 μm or larger) of 2.0% by weight and an MI of 3, and also changing the degree of surface polishing of the developer-carrying member of Example 17 to give a $C_{v5}$ of 0.6 μm and an Ra of 0.5 μm. Although the reflection density was slightly low as a whole, good images were obtained until 2,000 sheet reproduction in an environment of normal temperature and normal humidity and until 2,000 sheet reproduction in an environment of high temperature and high humidity.

EXAMPLE 20

Images were reproduced under the same conditions as in Example 17 except for using a toner with a weight average particle diameter of 10.0 μm, a fine-powder content (6.35 μm or smaller) of 28.3% by number, a coarse-powder content (20.2 μm or larger) of 0.8% by weight and an MI of 9. Although some images showed slight fading, which was not mattering in practical use, substantially good images were obtained until 2,000 sheet reproduction in an environment of normal temperature and normal humidity and until 1,000 sheet reproduction in an environment of high temperature and high humidity.

EXAMPLE 21

Images were reproduced under the same conditions as in Example 17 except for using a toner with a weight average particle diameter of 14.7 μm, a fine-powder content (6.35 μm or smaller) of 10.3% by number, a coarse-powder content (20.2 μm or larger) of 3.7% by weight and an MI of 9.7, and also changing the degree of surface polishing of the developer-carrying member of Example 17 to give a $C_{v5}$ of 2.6 μm and an Ra of 1.8 μm. Although images tended to have a low reflection density as a whole, no fading occurred on the level questionalble in practical use, and substantially good images were obtained until 2,000 sheet reproduction in an environment of normal temperature and normal humidity and until 1,000 sheet reproduction in an environment of high temperature and high humidity.

EXAMPLE 22

The developer prepared in Example 17 was fed to the image forming apparatus shown in FIG. 6 to carry out image reproduction tests in the same manner as in Example 17. Good results were obtained in environments of both the normal temperature and normal humidity and the high temperature and high humidity.

Images were reproduced under the following conditions:

(a) The surface of a developing sleeve made of aluminum, used in a laser beam printer (LBP-SX) was coated (layer thickness: about 6 μm) with a composition comprised of 9 parts of graphite particles (volume average particle diameter: 5 μm), 1 part of conductive fine carbon particles and 10 parts of phenol resin. A coated sleeve having a $C_{v5}$ of 0.9 μm and an Ra of 1.5 μm was thus prepared, and was used as the developer-carrying member 2.

(b) A laminate type OPC photosensitive drum of 30 mm in diameter was used as the electrostatic latent image bearing member 1.

(c) A blade made of iron was used as the blade 6, and the gap between the coated sleeve and the iron blade was set to be about 250 μm.

(d) The nearest distance between the coated sleeve and the OPC photosensitive drum in the developing zone was set to be about 300 μm.

(e) As the developing bias, an AC bias (Vpp: 1,600 V; frequency: 1,800 Hz) and a DC bias of −400 V were applied to the coated sleeve.

(f) The electrostatic latent image was developed by reverse development.

(g) Other image reproduction conditions were set to be the same as in the laser beam printer (LBP-SX).

Synthesis Example 5

First, 200 parts of cumene was put in a reaction vessel and heated to the reflux temperature. In this cumene, 85 parts of styrene monomer, 10 parts of acrylic acid monomer and 8.5 parts of di-tert-butyl peroxide were mixed. Under further reflux of cumene (146° C. to 156° C.), solution polymerization was completed, and then the temperature was raised to remove cumene. The resulting styrene/acrylic acid copolymer (30 parts) was dissolved in the following monomer mixture to give a mixed solution.

| Monomer mixture | Mixing proportion |
|---|---|
| Styrene monomer | 46 parts |
| n-Butyl acrylate monomer | 19 parts |
| Acrylic acid monomer | 3 parts |
| Divinyl benzene | 0.3 part |
| Benzoyl peroxide | 1.7 part |

In the above mixed solution, 170 parts by weight of water containing 0.1 part by weight of partially saponified polyvinyl alcohol was added to give a suspension dispersion. This dispersion was added in a reaction vessel containing 15 parts by weight of water and substituted with nitrogen, and suspension polymerization was carried out at a reaction temperature of from 70° to 95° C. for 6 hours. After completion of the reaction, the reaction mixture was filtered, dehydrated and dried to give a resin composition of copolymers. This composition was a uniform mixture of a styrene/acrylic acid copolymer and a styrene/acrylic acid/n-butyl acrylate copolymer.

This composition had an acid value of 25.0.

Synthesis Example 6

First, 200 parts of cumene was put in a reaction vessel and heated to the reflux temperature. The following mixture in cumene was subjected to solution polymerization under reflux. After completion of the reaction, the temperature was raised to remove cumene.

| Monomer mixture | Mixing proportion |
|---|---|
| Styrene monomer | 90 parts |

-continued

| Monomer mixture | Mixing proportion |
|---|---|
| Maleic acid n-butyl half ester monomer | 10 parts |
| Di-tert-butyl peroxide | 8.5 parts |

Next, 30 parts of the above styrene/maleic acid n-butyl half ester copolymer was dissolved in the following monomer mixture to give a mixture.

| Monomer mixture | Mixing proportion |
|---|---|
| Styrene monomer | 47 parts |
| n-Butyl acrylate monomer | 20 parts |
| Maleic acid n-butyl half ester monomer | 3 parts |
| Divinyl benzene | 0.25 part |
| Benzoyl peroxide | 1.5 parts |

The reaction was carried out in the same manner as in Synthesis Example 5 to give a composition of a styrene/maleic acid n-butyl half ester copolymer and a styrene/n-butyl acrylate/maleic acid n-butyl half ester copolymer.

This copolymer composition had an acid value of 20.6.

Synthesis Example 7

First, 200 parts of cumene was put in a reaction vessel and heated to the reflux temperature. To this cumene, a mixture of 78 parts of styrene monomer, 15 parts of n-butyl acrylate monomer, 7 parts of maleic acid n-butyl half ester, 0.3 part of divinyl benzene and 1.0 part of di-tert-butyl peroxide was dropwise added over a period of 4 hours under reflux of cumene to carry out polymerization for further 4 hours. Thereafter, the solvent was removed by conventional distillation under reduced pressure to give a copolymer.

The resulting copolymer had an acid value of 18.5

Comparative Synthesis Example 1

Synthesis Example 7 was repeated except that the styrene monomer was used in an amount of 82 parts, the n-butyl acrylate, 18 parts, and the maleic acid n-butyl half ester, 0 part.

The resulting copolymer had an acid value of 0.4.

Preparation Example 5

| | |
|---|---|
| Resin composition of Synthesis Example 5 | 100 parts |
| Magnetic material fine powder (bulk density: 1.0 g/cm$^3$) | 60 parts |
| Metal complex compound A-1 | 2 parts |
| Low-molecular weight ethylene/propylene copolymer (1) | 3 parts |

The above materials were melt-kneaded using a twin extruder heated to 140° C., then cooled. The kneaded product obtained was crushed using a hammer mill, and the crushed product was pulverized using a jet mill. The resulting finely pulverized product was further subjecte to a multi-division classifier utilizing the Coanda effect (Elbojet Classifier, manufactured by Nittetsuko K.K.) to simultaneously remove ultrafine powder and coarse powder by strict classification. Thus, magnetic toner (I) with a weight average particle diameter of 12 μm was obtained.

Preparation Example 6

| | |
|---|---|
| Resin composition of Synthesis Example 6 | 100 parts |
| Magnetic material fine powder (bulk density: 1.0 g/cm$^3$) | 70 parts |
| Metal complex oompound A-1 | 3 parts |
| Low-molecular weight ethylene/propylene copolymer (2) | 3 parts |

Except for using a mixture of the above, Preparation Example 5 was repeated to give a magnetic toner (II) with a weight average particle diameter of 11.5 μm.

Preparation Example 7

| | |
|---|---|
| Resin composition of Synthesis Example 7 | 100 parts |
| Magnetic material fine powder (bulk density: 0.42 g/cm$^3$) | 60 parts |
| Metal complex compound A-2 | 3 parts |
| Low-molecular weight ethylene/propylene copolymer (3) | 2 parts |

Using a mixture of the above, Preparation Example 5 was repeated to give a magnetic toner (III) with a weight average particle diameter of 12 μm.

Preparation Example 8

| | |
|---|---|
| Resin composition of Comparative Synthesis Example 1 | 100 parts |
| Magnetic material fine powder (bulk density: 0.26 g/cm3) | 60 parts |
| Low-molecular weight ethylene/propylene copolymer (2) | 4 parts |

Except for using the above components. Preparation Example 5 was repeated to give a magnetic toner (IV) with a weight average particle diameter of 11. μm.

Molecular weights at peaks in GPC charts of the ethylene/propylene copolymers used in the above Preparation Examples are shown in Table 3.

TABLE 3

| | Molecular weight at main peak | Molecular weight at other peak |
|---|---|---|
| Low-molecular weight ethylene-propylene | | |
| copolymer (1) | 14,000 | 950 |
| copolymer (2) | 50,000 | 1,500 |
| copolymer (3) | 12,000 | None |

EXAMPLE 23

After 100 parts of a fine silica powder with a BET specific surface area of 200 m$^2$/g (Aerosil #200; available from Japan Aerosil Co.) was treated with 20 parts of hexamethyldisiliazane (HMDS), the powder was treated 10 parts of dimethylsilicone oil (KF-96, 100 cS; available from Shin-Etsu Chemical Co., Ltd.) diluted with a solvent. After drying, a heat treatment at about 250° C. was carried out to give a fine silica powder pretreated with hexamethyldisilazane and dimethylsilicone oil. Then, 100 parts of the magnetic toner (I) and 0.6 part of the treated fine silica powder were blended to give a developer.

This developer was used in a commercially available laser beam printer LBP-SX (manufactured by Canon, Inc.) modified as follows: The surface of the developer-carrying member was coated with a composition comprising conductive graphite particles contained in phenol resin in a proportion of 1:1 (coating layer thickness: 7 μm). The resulting developer-carrying member was set in the printer to carry out image reproduction tests. As the developing bias, an AC bias of a Vpp of 1,600 V and a frequency of 1,800 Hz was applied.

As a result, it was possible to perform environment-independent and uniform development without sleeve memory (or fading) to provide good images in any environments, normal temperature and normal humidity (20° C., 60%RH), high temperature and high humidity (32.5° C., 85%RH) or low temperature and low humidity (15° C., 10%RH).

Images were further reproduced and evaluated on 5,000 sheets with the toner supplement, where unquestionable, uniform and good images were obtained. Neither adhesion of toner nor occurrence of scratches were seen on the surface of the developer-carrying member.

EXAMPLE 24

The fine silica powder in Example 23 was replaced with α-alumina (BET specific surface area: 100 $m^2/g$), which was similarly treated to give a treated fine alumina powder. Then, 0.8 part of this powder was externally added to 100 parts of the magnetic toner (II) to give a developer. Images were reproduced in the same way.

As a result, the image density lowered after 3,000 sheet reproduction in an environment of high temperature and high humidity, compared with Example 23, but on the level of no problems. The images were good images uniform and free of sleeve memory as those in Example 23. Neither adhesion of toner nor occurrence of scratches were seen on the surface of the developer-carrying member after 3,000 sheet image reproduction.

EXAMPLE 25

The fine silica powder in Example 23 was treated with 10 parts of dimethylsilicone oil (KF-96) diluted with a solvent. After drying, a heat treatment at about 280° C. was carried out to give a silica powder pretreated with dimethylsilicone oil. Then, 0.4 part of this powder was externally added to 100 parts of the magnetic toner (III) to give a developer. Images were reproduced in the same manner as in Example 23. As a result, it was possible to obtain sleeve memory-free, good images until 4,000 sheet reproduction. Adhesion of the developer was slightly seen on the surface of the developer-carrying member, but on the level of no influence on the images.

Comparative Example 4

100 parts of a fine silica powder with a BET specific surface area of 130 $m^2/g$ (Aerosil #130; available from Japan Aerosil Co.) was treated with 20 parts of HMDS to give a fine silica powder pretreated with HMDS. Then, 0.9 part of this powder was externally added to 100 parts of the magnetic toner (IV) to give a developer. Using this developer, images were reproduced and evaluated in the same manner as in Example 23. As a result, image became uneven after several ten sheet of image reproduction. Images were further formed until 1,000 sheet reproduction, but the image eveness was not restored. A number of streaks appeared on the surface of the developer-carrying member to cause several white lines on the images.

EXAMPLE 26

The developer-carrying member in Example 23 was replaced with a developer-carrying member whose surface was coated with a composition comprising conductive graphite particles contained in phenol resin in a proportion of 1:1.5 (layer thickness: 6.5 μm). Using the same developer as used in Example 23, images were reproduced in the same manner as in Example 23.

As a result, it was possible to obtain uniform and sleeve memory-free, good images until 5,000 sheet reproduction. Neither scratches nor adhesion of the developer was seen on the surface of the developer-carrying member.

Preparation Example 9

| | |
|---|---|
| Styrene/n-butyl acrylate copolymer (copolymerization weight ratio: 8:2; weight average molecular weight (Mw): 230,000) | 100 parts |
| Magnetic material fine powder (BET specific surface area: 7.2 $m^2/g$) | 60 parts |
| Charge control agent A (structural formula A-1; $\bar{d}_v$: 6.0 μm; $\bar{d}_n$: 3.2 μm; R: $10^9$ Ω · cm) | 2.0 parts |
| Charge control agent B (structural formula B-1; $\bar{d}_v$: 6.5 μm; $\bar{d}_n$: 4.0 μm; R: $10^{10}$ Ω · cm) | 1.0 part |
| Low-molecular weight polypropylene ($P_1$: 16,000; $P_2$: 950) | 3 parts |

The above materials were melt-kneaded using a twin extruder heated to 140° C., and then cooled. The kneaded product obtained was crushed using a hammer mill, and the crushed product was pulverized using a jet mill. Then the resulting pulverized product was air-classified to give a negatively chargeable magnetic toner (classified powder) with a weight average particle diameter of 11.7 μm.

| | |
|---|---|
| Styrene/2-ethylhexyl acrylate copolymer (copolymerization weight ratio: 8:2; Mw: 250,000) | 100 parts |
| Magnetic material fine powder (BET specific surface area: 5.3 $m^2/g$) | 60 parts |
| Charge control agent A (structural formula A-2; $\bar{d}_v$: 6.0 μm; $\bar{d}_n$: 3.4 μm; R: $10^9$ Ω · cm) | 1.0 part |
| Charge control agent B (structural formula B-2; dv: 5.6 μm; dn: 4.0 μm; R: $10^{10}$ Ω · cm) | 3.0 parts |
| Low-molecular weight polypropylene ($P_1$: 16,000; $P_2$: 950) | 3 parts |

The above materials were melt-kneaded, followed by pulverization and classification to give a negatively chargeable magnetic toner with a weight average particle diameter of 11.3 μm.

Examples concerned with developers containing the above toners follow.

EXAMPLE 27

First, 100 parts of a fine silica powder with a BET specific surface area of 200 $m^2/g$ (Aerosil #200; available from Japan Aerosil Co.) was treated with 20 parts of hexamethyldisilazane (HMDS), and thereafter treated with 10 parts of dimethylsilicone oil (KF-96, 100 cS; available from Shin-Etsu Chemical Co., Ltd.) diluted with a solvent. After drying, a heat treatment at about 250° C. was carried out to give a fine silica powder pretreated with hexamethyldisilazane and dimethylsilicone oil. Then. 100 parts of the toner obtained in Preparation Example 9 above and 0.7 part of the treated fine silica powder were blended under dry conditions to give an externally silica-added magnetic toner (a developer).

This developer was used in a laser beam printer LBP-SX (manufactured by Canon, Inc.) modified as follows: The surface of the developer-carrying member (sleeve) was coated with a composition comprising conductive graphite particles contained in phenol resin in a proportion of 1:1 (coating layer thickness: 6.5 μm). The sleeve thus coated was set in the printer. Primary charging was effected at −600 V to form a reverse electrostatic latent image. Setting a gap (300 μm) between the photosensitive drum and the developer layer on the developing sleeve having a magnet in it (in an non-contact state), an AC bias (f: 1,800 Hz Vpp: 1,200 V) and a DC bias: ($V_{DC}$: −450 V) were applied to the developing sleeve to convert transfer potential to the reverse polarity. Printed images were obtained in an environment of normal temperature and normal humidity (20° C., 60%RH), high temperature and high humidity (30° C., 80%RH) or low temperature and low humidity (15° C., 10%RH) respectively. Evaluation was made on each item shown later, and the results are shown in Table 4.

EXAMPLE 28

100 parts of fine α-alumina powder (average particle diameter: 0.020 μm; BET specific surface area: 100 $cm^2/g$ ) was treated in the same manner as in Example 27 to give a treated alumina.

To 100 parts of the magnetic toner obtained in Preparation Example 10, 0.7 part of the treated alumina was added, which were blended under dry conditions in the same manner as in Example 27 to give a developer. Evaluation and studies were made in the same manner as in Example 27 to obtain the results as shown in Table 4.

EXAMPLE 29

100 parts of a fine silica powder with a PET specific surface area of 130 $m^2/g$ (Aerosil #130; available from Japan Aerosil Co.) was treated with 20 parts of dimethylsilicone oil. After drying, a heat treatment at about 280° C. was carried out to give a treated fine silica powder.

To 100 parts of the magnetic toner obtained in Preparation Example 10, 0.7 part of the treated silica was added, which were blended under dry conditions to give a developer. Evaluation and studies were made in the same manner as in Example 27 but using a developer-carrying member wherein the coat layer of the developer-carrying member used in Example 27 was replace with a coat layer formed by coating a composition comprising graphite particles contained in phenol resin in a proportion of 1:1.5 (layer thickness: 7 μm). Results obtained are shown in Table 4.

EXAMPLE 30

100 parts of a fine silica powder with a BET specific surface area of 300 $m^2/g$ (Aerosil #300; available from Japan Aerosil Co.) was treated with 30 parts of an olefin-modified silicone oil (KF-415; available from Shin-Etsu Chemical Co., Ltd.) in the same manner as in Example 28 to give a developer. Results are shown in Table 4.

EXAMPLE 31

100 parts of a fine silica powder with a BET specific surface area of 200 $m^2/g$ (Aerosil #200; available from Japan Aerosil Co.) was treated with 30 parts of fluorine-modified silicone oil (200 cS) in the same manner as in Example 28 to give a developer. Results are shown in Table 4.

EXAMPLE 32

100 parts of a fine silica powder with a BET specific surface area of 130 $m^2/g$ (Aerosil #130; available from Japan Aerosil Co.) was treated with 5 parts of α-methylstyrene-modified silicone oil (KF-410; available from Shin-Etsu Chemical Co., Ltd.) in the same manner as in Example 29 to give a developer. Results are shown in Table 4.

TABLE 4

| | Normal* | | High** | | Low*** | |
|---|---|---|---|---|---|---|
| | Image density | Line reproduction | Image density | Line reproduction | Image density | Line reproduction |
| Example | | | | | | |
| 27 | (a) 1.37 | AA | (a) 1.36 | AA | (a) 1.37 | AA |
| | (b) 1.35 | AA | (b) 1.31 | AA | (b) 1.35 | AA |
| 28 | (a) 1.33 | A | (a) 1.32 | A | (a) 1.35 | A |
| | (b) 1.30 | A | (b) 1.28 | B | (b) 1.31 | A |
| 29 | (a) 1.37 | A | (a) 1.35 | A | (a) 1.36 | AA |
| | (b) 1.33 | A | (b) 1.30 | A | (b) 1.32 | A |
| 30 | (a) 1.37 | A | (a) 1.34 | AA | (a) 1.37 | AA |
| | (b) 1.31 | A | (b) 1.29 | A | (b) 1.29 | A |
| 31 | (a) 1.36 | A | (a) 1.34 | A | (a) 1.36 | A |
| | (b) 1.33 | A | (b) 1.29 | A | (b) 1.27 | B |
| 32 | (a) 1.36 | A | (a) 1.33 | A | (a) 1.36 | A |
| | (b) 1.30 | A | (b) 1.28 | B | (b) 1.30 | A |

*Normal temperature and normal humidity
**High temperature and high humidity
***Low temperature and low humidity
(a): Initial printed image
(b): 5,000 sheet printed image

(1) Image Density

Macbeth Reflection Densitometer (manufactured by Macbeth Co.) was used to measure relative density with respect to copied images on the white ground having an original density of 0.0.

(2) Image Quality

From the viewpoint of line reproduction, printed images were visually judged on five points, i.e., black spots around images, blank areas, faint images, uneven images, and sharpness. Image quality that is poor and questionable from a practical view point was evaluated as "C"; image quality that is slightly poor but on the level of practical use, as "B"; good image quality, as "A"; and excellent image quality, as "AA".

The "black spots around images" indicates a phenomenon in which developer scatters around an image The "blank areas" indicates a phenomenon in which part of an image lacks. The "faint images" indicates a phenomenon in which an image has a density difference in stripes. The "uneven images" indicates a phenomenon in which an image has density difference.

We claim:

1. An image forming apparatus comprising an electrostatic latent image bearing member and a developing apparatus for developing an electrostatic latent image;

said developing apparatus comprising a developer container in which a developer is held, and a developer-carrying member for carrying thereon the developer and transporting the developer to a developing zone;

said developer-carrying member having a surface layer of a resin containing at least conductive fine particles, a solid lubricant or a mixture thereof, said surface layer having in a relative load curve (Abbot's load curve) with a cutting depth $C_v$ of not more than 5 μm when a relative load length $t_p$ is 5%; and said developer containing a toner and a fine powder pretreated with a silicone oil or silicone varnish.

2. The apparatus according to claim 1, wherein said surface layer of said developer-carrying member has a cutting depth $C_v$ of from 0.5 μm to 5 μm.

3. The apparatus according to claim 1, wherein the surface of said developer-carrying member has been subjected to surface polishing.

4. The apparatus according to claim 2, wherein the surface of said developer-carrying member has been subjected to surface polishing.

5. The apparatus according to claim 1, wherein the surface of said developer-carrying member is controlled by polishing a surface having a cutting depth $C_v$ of more than 5 μm.

6. The apparatus according to claim 1, wherein the surface of said developer-carrying member contains graphite particles.

7. The apparatus according to claim 1, wherein the surface of said developer-carrying member contains conductive carbon particles.

8. The apparatus according to claim 1, wherein the surface of said developer-carrying member contains graphite particles and conductive carbon particles.

9. The apparatus according to claim 1, wherein said developer-carrying member comprises a developing sleeve with a magnet inside said developing sleeve, and said developer comprises a magnetic toner and a fine powder pretreated with a silicone oil.

10. The apparatus according to claim 9, wherein said developer comprises an insulative magnetic toner and a fine powder pretreated with a silicone oil.

11. The apparatus according to claim 1, wherein said surface layer of said developer-carrying member has a thickness of from 0.5 μm to 30 μm.

12. The apparatus according to claim 1, wherein said surface layer of said developer-carrying member has a thickness of from 2 μm to 20 μm.

13. The apparatus according to claim 1, wherein said solid lubricant comprises graphite particles having a particle diameter of from 0.5 μm to 10 μm.

14. The apparatus according to claim 1, wherein said conductive fine particles comprise amorphous carbon particles having a particle diameter of from 5 μm to 100 μm.

15. The apparatus according to claim 1, wherein said conductive fine particles comprise amorphous carbon particles having a particle diameter of from 10 μm to 80 μm.

16. The apparatus according to claim 1, wherein said conductive fine particles comprise amorphous carbon particles having a particle diameter of from 15 μm to 40 μm.

17. The apparatus according to claim 1, wherein said surface layer of said developer-carrying member has a volume resistivity of from $10^{-6}$ Ω.cm to $10^{6}$ Ω.cm.

18. The apparatus according to claim 1, wherein said surface layer of said developer-carrying member comprises graphite particles, conductive carbon particles, or a mixture of these, and a resin selected from the group consisting of a phenol resin, a silicone resin, a fluorine resin, a polyether sulfone, a polycarbonate, a polyphenylene oxide, a polyamide and a polystyrene resin.

19. The apparatus according to claim 1, wherein said surface layer of said developer-carrying member comprises graphite particles, conductive carbon particles, or a mixture of these, and a phenol resin.

20. The apparatus according to claim 1, wherein said electrostatic latent image bearing member comprises a laminated OPC photosensitive drum.

21. The apparatus according to claim 1, wherein said toner contains a binder resin having i) a polymerizable monomer unit contained in an amount of from 2 parts by weight to 30 parts by weight based on a total weight of the resin, the monomer unit having an acid group comprised of a carboxyl group or an acid anhydride thereof, and ii) an acid value of from 1 to 70 for the resin as a whole.

22. The apparatus according to claim 1, wherein said toner contains a metal complex compound (A) of an aromatic hydroxycarboxylic acid having a lipophilic group.

23. The apparatus according to claim 1, wherein said toner contains a metal complex salt monoazo dye (B) having a hydrophilic group.

24. The apparatus according to claim 1, wherein said toner contains a metal complex compound (A) or an aromatic hydroxycarboxylic acid having a lipophilic group, and a metal complex salt monoazo dye (B) having a hydrophilic group.

25. The apparatus according to claim 22, wherein said metal complex compound (A) has a structure selected from the group consisting of the following formulas (I), (II) and (III)

Formula I

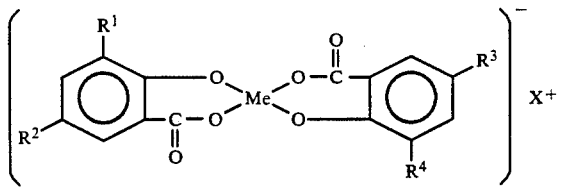

wherein $R^1$ to $R^4$ are identical or different from each other, and each represents a hydrogen atom or an alkyl or alkenyl group having 1 to 10 carbon atoms, provided that at least one of $R^1$ to $R^4$ represents said alkyl or alkenyl group; Me represents Cr, Ni, Co, Cu or Zn; and $X^+$ represents $H^+$, $K^+$, $Na^+$, $NH_4^+$ or $Li^+$ Formula (II)

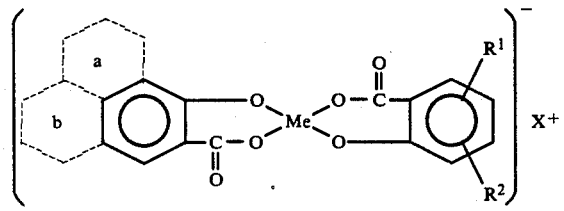

wherein $R^1$ to $R^4$ are identical or different from each other, and each represents a hydrogen atom or an alkyl or alkenyl group having 1 to 10 carbon atoms, one or both of a and b is a benzene ring or a cyclohexene ring, or one of a and b is a benzene ring or cyclohexene ring and the other is an alkyl group having 4 to 9 carbon atoms; Me represents Cr, Ni, Co, Cu or Zn; and $X^+$ represents $H^+$, $K^+$, $Na^+$, $NH_4^+$ or $Li^+$ Formula (III)

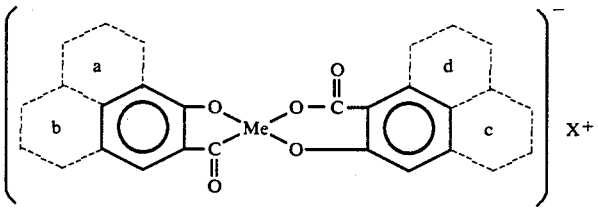

wherein one or both of a and b is a benzene ring or a cyclohexene ring or one of a and b is a benzene ring or cyclohexene ring and the other is an alkyl group having 4 to 9 carbon atoms; and one or both of c and d is a benzene ring or a cyclohexene ring or one of c and d is a benzene ring or cyclohexene ring and the other is an alkyl group having 4 to 9 carbon atoms; Me represents Cr, Ni, Co, Cu or Zn; and $X^+$ represents $H^+$, $K^+$, $Na^+$, $NH_4^+$ or $Li^+$.

26. The apparatus according to claim 23, wherein said metal complex salt monoazo dye (B) has a structure selected from the group consisting of the following formulas (IV) and (V)

Formula (IV)

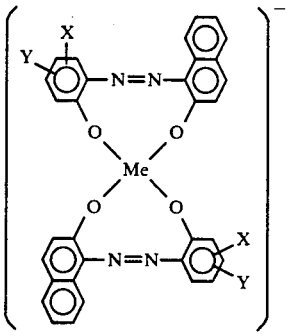

wherein at least one of X and Y represent(s) a hydrophilic group, and the other of X and Y represent(s) a hydrogen atom or an alkyl group having 1 to 10 carbon atoms; Me represents Cr, Ni, Co, Cu, Zn or Fe; and $A^+$ represents $H^+$, $K^+$, $Na^+$, $NH_4^+$ or $Li^+$ Formula (V)

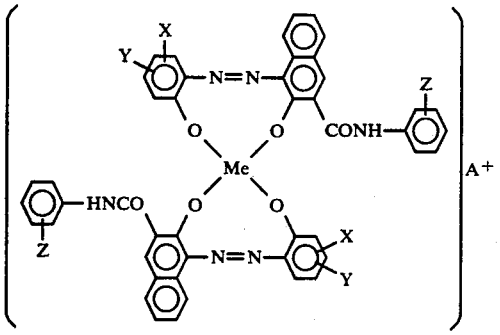

wherein at least one of X, Y and Z represent(s) a hydrophilic group, and any of the others of X, Y and Z represents a hydrogen atom or an alkyl group having 1 to 10 carbon atoms; Me represents Cr, Ni, Co, Cu, Zn or Fe; and $A^+$ represents $H^+$, $K^+$, $Na^+$, $NH_4^+$ or $Li^+$.

27. The apparatus according to claim 23, wherein said hydrophilic group is a group selected from the group consisting of $-SO_3H$, $-SO_3M$, $-COOM$, $-NR_3X$, $-COOH$, $-NH_2$, $-CN$, $-OH$, $-NHCONH_2$, $-X$, and $-NO_2$, wherein R represents an alkyl group, M represents an alkali metal or $-NH_4$, and X represents a halogen atom.

28. The apparatus according to claim 1, wherein said toner has a weight average particle diameter $D_4$ of 10 μm to 15 μm, a fine-powder content (particle diameter: 6.35 μm or smaller) of not more than 30% by number, a coarse-powder content (particle diameter: 20.2 μm or larger) of not more than 4% by weight, and an MI (melt index) value of not more than 10.

29. The apparatus according to claim 1, wherein said toner comprises a binder resin, magnetic particles and a charge control agent:

said binder resin having i) a polymerizable monomer unit contained in an amount of from 2 parts by weight to 30 parts by weight based on a total weight of the resin, said monomer unit having an acid group comprised of a carboxyl group or an acid anhydride thereof, and ii) an acid value of from 1 to 70 as that of the resin as a whole;

said magnetic particles having a bulk density of not less than 0.35 g/cm$^3$; and said charge control agent comprises a metal complex salt monoazo dye having a hydrophilic group.

30. The apparatus according to claim 1, wherein said toner contains a cross-linked styrene copolymer.

31. The apparatus according to claim 29, wherein said binder resin contained a cross-linked styrene copolymer.

32. The apparatus according to claim 1, wherein said toner contains a weight average particle diameter $D_4$ of 5 μm to 15 μm.

33. The apparatus according to claim 1, wherein said toner contains a low-molecular weight polyalkylene.

34. The apparatus according to claim 33, wherein said toner shows two or more maximum values in a chromatogram in gel permeation chromatography.

35. The apparatus according to claim 1, wherein said developer comprises an insulative magnetic toner and a fine silica powder pretreated with a silicone oil.

36. The apparatus according to claim 1, wherein said developer comprises an insulative magnetic toner and a fine silica powder pretreated with a silane coupling agent and a silicone oil.

37. The apparatus according to claim 1, wherein said developer comprises an insulative magnetic toner and an alumina powder pretreated with a silicone oil.

38. The apparatus according to claim 1, wherein said developer-carrying member is equipped with a means for applying a bias.

39. The apparatus according to claim 1, wherein said electrostatic latent image bearing member has a digital latent image.

40. The apparatus according to claim 39, wherein said electrostatic latent image bearing member has an OPC photosensitive layer and a digital latent image formed by exposure to laser light.

41. An apparatus unit comprising an electrostatic latent image bearing member and a developing apparatus for developing an electrostatic latent image;

said developing apparatus comprising a developer container in which a developer is held, and a developer-carrying member for carrying thereon the developer and transporting the developer to a developing zone;

said developer-carrying member having a surface layer of a resin containing at least conductive fine particles, a solid lubricant or a mixture thereof, said surface layer having in a relative load curve (Abbot's load curve) with a cutting depth $C_v$ of not more than 5 μm when a relative load length $t_p$ is 5%;

said developer containing a toner and a fine powder pretreated with a silicone oil or silicone varnish; and said developing apparatus being supported together with said electrostatic latent image bearing member to from a single unit, and said single unit being detachably provided in a body of an electrophotographic apparatus.

42. The apparatus unit according to claim 41, wherein said surface layer of said developer-carrying member has a cutting depth $C_v$ of from 0.5 μm to 5 μm.

43. The apparatus unit according to claim 41, wherein the surface of said developer-carrying member has been subjected to surface polishing.

44. The apparatus unit according to claim 42, wherein the surface of said developer-carrying member has been subjected to surface polishing.

45. The apparatus unit according to claim 41, wherein the surface of said developer-carrying member is controlled by polishing a surface having a cutting depth $C_v$ of more than 5 μm.

46. The apparatus unit according to claim 41, wherein the surface of said developer-carrying member contains graphite particles.

47. The apparatus unit according to claim 41, wherein the surface of said developer-carrying member contains conductive carbon particles.

48. The apparatus unit according to claim 41, wherein the surface of said developer-carrying member contains graphite particles and conductive carbon particles.

49. The apparatus unit according to claim 41, wherein said developer-carrying member comprises a developing sleeve having with a magnet inside said developing sleeve, and said developer comprises a magnetic toner and a fine powder pretreated with a silicone oil.

50. The apparatus unit according to claim 49, wherein said developer comprises an insulative magnetic toner and a fine powder pretreated with a silicone oil.

51. The apparatus unit according to claim 41, wherein said surface layer of said developer-carrying member has a thickness of from 0.5 μm to 30 μm.

52. The apparatus unit according to claim 41, wherein said surface layer of said developer-carrying member has a thickness of from 2 μm to 20 μm.

53. The apparatus unit according to claim 41, wherein said solid lubricant comprises graphite particles having a particle diameter of from 0.5 μm to 10 μm.

54. The apparatus unit according to claim 41, wherein said conductive fine particles comprise amorphous carbon particles having a particle diameter of from 5 μm to 100 μm.

55. The apparatus unit according to claim 41, wherein said conductive fine particles comprise amorphous carbon particles having a particle diameter of from 10 μm to 80 μm.

56. The apparatus unit according to claim 41, wherein said conductive fine particles comprise amorphous carbon particles having a particle diameter of from 15 μm to 40 μm.

57. The apparatus unit according to claim 41, wherein said surface layer of said developer-carrying member has a volume resistivity of from $10^{-6}$ Ω.cm to $10^{6}$ Ω.cm.

58. The apparatus unit according to claim 41, wherein said surface layer of said developer-carrying member comprises graphite particles, conductive carbon particles, or a mixture of these, and a resin selected from the group consisting of a phenol resin, a silicone resin, a fluorine resin, a polyether sulfone, a polycarbonate, a polyphenylene oxide, a polyamide and a polystyrene resin.

59. The apparatus unit according to claim 41, wherein said surface layer of said developer-carrying member comprises graphite particles, conductive carbon particles, or a mixture of thereof, and a phenol resin.

60. The apparatus unit according to claim 41, wherein said electrostatic latent image bearing member comprises a laminated OPC photosensitive drum.

61. The apparatus unit according to claim 41, wherein said toner contains a binder resin having i) a polymerizable monomer unit contained in an amount of from 2 parts by weight to 30 parts by weight based on a total weight of the resin, said monomer unit having an acid group comprised of a carboxyl group or an acid anhydride thereof, and ii) an acid value of from 1 to 70 as that of the resin as a whole.

62. The apparatus unit according to claim 41, wherein said toner contains a metal complex compound (A) of a aromatic hydroxycarboxylic acid having a lipophilic group.

63. The apparatus unit according to claim 41, wherein said toner contains a metal complex salt monoazo dye (B) having a hydrophilic group.

64. The apparatus unit according to claim 41, wherein said toner contain a metal complex compound (A) of an aromatic hydroxycarboxylic acid having a lipophilic group, and a metal complex salt monoazo dye (B) having a hydrophilic group.

65. The apparatus according to claim 62, wherein said metal complex compound (A) has a structure selected from the group consisting of the following formulas (I), (II) and (III)

Formula (I)

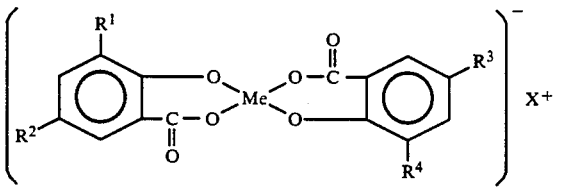

wherein $R^1$ to $R^4$ are identical or different from each other, and each represent a hydrogen atom or an alkyl or alkenyl group having 1 to 10 carbon atoms, provided that at least one of $R^1$ to $R^4$ represents said alkyl or alkenyl group; Me represents Cr, Ni, Co, Cu or Zn; and $X^+$ represents $H^+$, $K^+$, $Na^+$, $NH_4^+$ or $Li^+$ Formula (II)

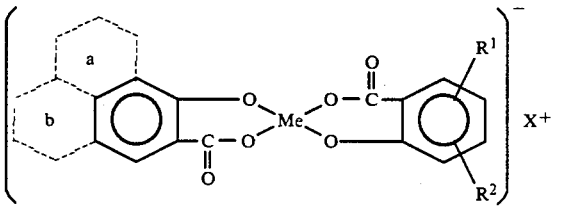

wherein $R^1$ and $R^2$ are identical or different from each other, and each represents a hydrogen atom or an alkyl or alkenyl group having 1 to 10 carbon atoms; one or both of a and b is a benzene ring or a cyclohexene ring, or one of a and b is a benzene ring or cyclohexene ring and the other is an alkyl group having 4 to 9 carbon atoms; Me represents Cr, Ni, Co, Cu or Zn; and $X^+$ represents $H^+$, $K^+$, $Na^+$, $NH_4^+$ or $Li^+$ Formula (III)

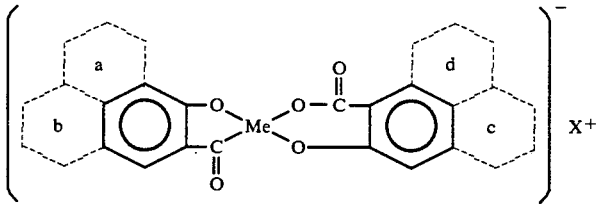

wherein one or both of a and b is a benzene ring or a cyclohexene ring or one of a and b is a benzene ring or cyclohexene ring and the other is an alkyl group having 4 to 9 carbon atoms; and one or both of c and d is a benzene ring or a cyclohexene ring or one of c and d is a benzene ring or cyclohexene ring and the other is an alkyl group having 4 to 9 carbon atoms; Me represents Cr, Ni, Co, Cu or Zn; and $X^+$ represents $H^+$, $K^+$, $Na^+$, $NH_4^+$ or $Li^+$.

66. The apparatus unit according to claim 63, wherein said metal complex salt monoazo dye (B) has a structure selected from the group consisting of the following formulas (IV) and (V)

Formula (IV)

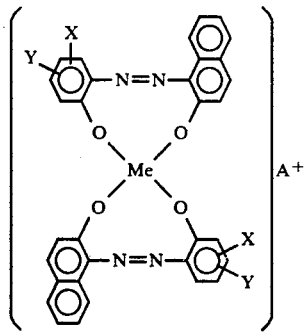

wherein at least one of X and Y represent(s) a hydrophilic group, and the other of X and Y represent(s) a hydrogen atom or an alkyl group having 1 to 10 carbon atoms; Me represents Cr, Ni, Co, Cu, Zn or Fe; and $A^+$ represents $H^+$, $K^+$, $Na^+$, $NH_4^+$ or $Li^+$ Formula (V)

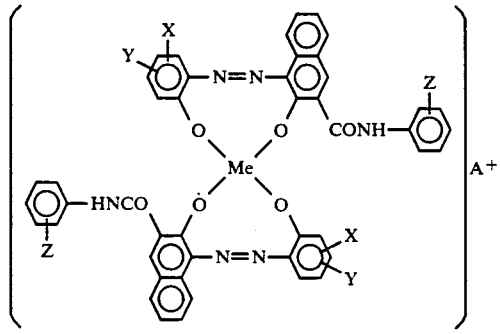

wherein at least one of X, Y and Z represent(s) a hydrophilic group, and any of the others of X, Y and Z represents a hydrogen atom or an alkyl group having 1 to 10 carbon atoms; Me represents Cr, Ni, Co, Cu, Zn or Fe; and $A^+$ represents $H^+$, $K^+$, $Na^+$, $NH_4^+$ or $Li^+$.

67. The apparatus unit according to claim 63, wherein said hydrophilic group is a group selected from the group consisting of $-SO_3H$, $-SO_3M$, $-COOM$, $-NR_3X$, $-COOH$, $-NH_2$, $-CN$, $-OH$, $-NHCONH_2$, $-X$, and $-NO_2$, wherein R represents an alkyl group, M represents an alkali metal or $-NH_4$, and X represents a halogen atom.

68. The apparatus unit according to claim 41, wherein said toner has a weight average particle diameter $D_4$ of 5 μm to 15 μm, a fine-powder content (particle diameter: 6.35 μm or smaller) of not more than 30% by number, a coarse-powder content (particle diameter: 20.2 μm or larger) of not more than 4% by weight, and an MI (melt index) value of not more than 10.

69. The apparatus unit according to claim 41, wherein said toner comprises a binder resin, magnetic particles and a charge control agent;

said binder resin having i) a polymerizable monomer unit contained in an amount of from 2 parts by weight to 30 parts by weight based on a total weight of the resin, said monomer unit having an acid group comprised of a carboxyl group or an acid anhydride thereof, and ii) an acid value of from 1 to 70 as that of the resin as a whole;

said magnetic particles having a bulk density of not less than 0.35 g/cm$^3$; and said charge control agent comprises a metal complex salt monoazo dye having a hydrophilic group.

70. The apparatus unit according to claim 41, wherein said toner contains a cross-linked styrene copolymer.

71. The apparatus unit according to claim 69, wherein said binder resin contains a cross-linked styrene copolymer.

72. The apparatus unit according to claim 41, wherein said toner has a weight average particle diameter $D_4$ of 5 μm to 15 μm.

73. The apparatus unit according to claim 41, wherein said toner contains a low-molecular weight polyalkylene.

74. The apparatus unit according to claim 73, wherein said toner shows two or more maximum peaks in a chromatogram in gel permeation chromatography.

75. The apparatus unit according to claim 41, wherein said developer comprises an insulative magnetic toner and a fine silica powder pretreated with a silicone oil.

76. The apparatus unit according to claim 41, wherein said developer comprises an insulative magnetic toner and a fine silica powder pretreated with a silane coupling agent and a silicone oil.

77. The apparatus according to claim 41, wherein said developer comprises an insulative magnetic toner and an alumina powder pretreated with a silicone oil.

78. The apparatus according to claim 41, wherein said developer-carrying member is equipped with a means for applying a bias.

79. The apparatus according to claim 41, wherein said electrostatic latent image bearing member has a digital latent image.

80. The apparatus according to claim 79, wherein said electrostatic latent image bearing member has an OPC photosensitive layer and a digital latent image formed by exposure to laser light.

81. A facsimile apparatus comprising an electrophotographic apparatus and a receiver means for receiving image information from a remote terminal, wherein said electrophotographic apparatus comprises an electrostatic latent image bearing member and a developing apparatus for developing an electrostatic latent image;

said developing apparatus comprising a developer container in which a developer is held, and a developer-carrying member for carrying thereon the developer and transporting the developer to a developing zone;

said developer-carrying member having a surface layer of a resin containing at least conductive fine particles, a solid lubricant or a mixture thereof, said surface layer having in a relative load curve (Abbot's load curve) with a cutting depth $C_v$ of not more than 5 μm when a relative load length $t_p$ is 5%; and said developer containing a toner and a fine powder pretreated with a silicone oil or silicone varnish.

82. The apparatus according to claim 81, wherein said surface layer of said developer-carrying member has a cutting depth $C_v$ of from 0.5 μm to 5 μm.

83. The apparatus according to claim 81 wherein the surface of said developer-carrying member has been subjected to surface polishing.

84. The apparatus according to claim 82, wherein the surface of said developer-carrying member has been subjected to surface polishing.

85. The apparatus according to claim 81, wherein the surface of said developer-carrying member is controlled by polishing a surface having a cutting depth $C_v$ of more than 5 μm.

86. The apparatus according to claim 81, wherein the surface of said developer-carrying member contains graphite particles.

87. The apparatus according to claim 81, wherein the surface of said developer-carrying member contains conductive carbon particles.

88. The apparatus according to claim 81 wherein the surface of said developer-carrying member contains graphite particles and conductive carbon particles.

89. The apparatus according to claim 81 wherein said developer-carrying member comprises a developing sleeve with a magnet inside said developing sleeve and said developer comprises a magnetic toner and a fine powder pretreated with a silicone oil.

90. The apparatus according to claim 81, wherein said developer comprises an insulative magnetic toner and a fine powder pretreated with a silicone oil.

91. The apparatus according to claim 81, wherein said surface layer of said developer-carrying member has a thickness of from 0.5 μm to 30 μm.

92. The apparatus according to claim 81, wherein said surface layer of said developer-carrying member has a thickness of from 2 μm to 20 μm.

93. The apparatus according to claim 81, wherein said solid lubricant comprises graphite particles having a particle diameter of from 0.5 μm to 10 μm.

94. The apparatus according to claim 81, wherein said conductive fine particles comprise amorphous carbon particles having a particle diameter of from 5 μm to 100 μm.

95. The apparatus according to claim 81, wherein said conductive fine particles comprise amorphous carbon particles having a particle diameter of from 10 μm to 80 μm.

96. The apparatus according to claim 81, wherein said conductive fine particles comprise amorphous carbon particles having a particle diameter of from 15 μm to 40 μm.

97. The apparatus according to claim 81, wherein said surface layer of said developer-carrying member has a volume resistivity of from $10^{-6}$ Ω.cm to $10^6$ Ω.cm.

98. The apparatus according to claim 81, wherein said surface layer of said developer-carrying member comprises graphite particles, conductive carbon particles, or a mixture of these, and a resin selected from the group consisting of a phenol resin, a silicone resin, a fluorine resin, a polyether sulfone, a polycarbonate, a polyphenylene oxide, a polyamide and a polystyrene resin.

99. The apparatus according to claim 81, wherein said surface layer of said developer-carrying member comprises graphite particles, conductive carbon particles, or a mixture of these, and a phenol resin.

100. The apparatus according to claim 81, wherein said electrostatic latent image bearing member comprises a laminated OPC photosensitive drum.

101. The apparatus according to claim 81, wherein said toner contains a binder resin having i) a polymerizable monomer unit contained in an amount of from 2 parts by weight to 30 parts by weight based on a total weight of the resin, the monomer unit having an acid group comprised of a carboxyl group or an acid anhydride thereof, and ii) an acid value of from 1 to 70 for the resin as a whole.

102. The apparatus according to claim 81, wherein said toner contains a metal complex compound (A) of an aromatic hydroxycarboxylic acid having a lipophilic group.

103. The apparatus according to claim 81, wherein said toner contains a metal complex salt monoazo dye (B) having a hydrophilic group.

104. The apparatus according to claim 81, wherein said toner contains a metal complex compound (A) of an aromatic hydroxycarboxylic acid having a lipophilic group, and a metal complex salt monoazo dye (B) having a hydrophilic group.

105. The apparatus according to claim 102, wherein said metal complex compound (A) has a structure selected from the group consisting of the following formulas (I), (II) and (III)

Formula (I)

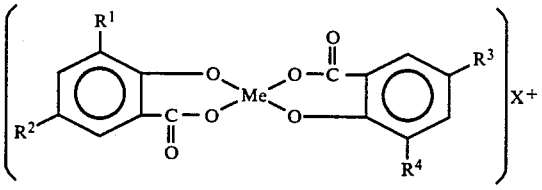

wherein $R^1$ to $R^4$ are identical or different from each other, and each represent a hydrogen atom or an alkyl or alkenyl group having 1 to 10 carbon atoms, provided that at least one of $R^1$ to $R^4$ represents said alkyl or alkenyl group; Me represents Cr, Ni, Co, Cu or Zn; and $X^+$ represents $H^+$, $K^+$, $Na^+$, $NH_4^+$ or $Li^+$ Formula (II)

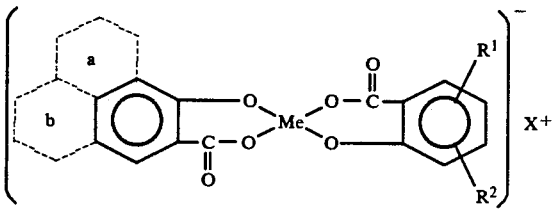

wherein $R^1$ to $R^2$ are identical or different from each other, and each represents a hydrogen atom or an alkyl or alkenyl group having 1 to 10 carbon atoms; one or both of a and b is a benzene ring or a cyclohexene ring or one of a and b is a benzene ring or cyclohexene ring and the other is an alkyl group having 4 to 9 carbon atoms; Me represents Cr, Ni, Co, Cu or Zn; and $X^+$ represents $H^+$, $K^+$, $Na^+$, $NH_4^+$ or $Li^+$ Formula (III)

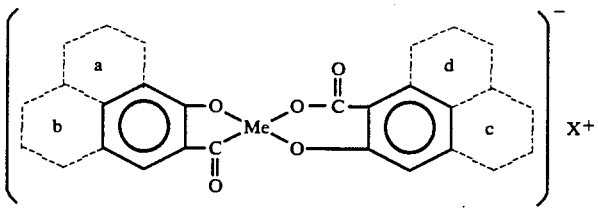

wherein one or both of a and b is a benzene ring or a cyclohexene ring or one of a and b is a benzene ring or cyclohexene ring and the other is an alkyl group having 4 to 9 carbon atoms; and one or both of c and d is a benzene ring or a cyclohexene ring or one of c and d is a benzene ring or cyclohexene ring and the other is an alkyl group having 4 to 9 carbon atoms; Me represents Cr, Ni, Co, Cu or Zn; and $X^+$ represents $H^+$, $K^+$, $Na^+$ $NH_4^+$ or $Li^+$.

106. The apparatus according to claim 103, wherein said metal complex salt type monoazo dye (B) has a structure selected from the group consisting of the following formulas (IV) and (V)

Formula (IV)

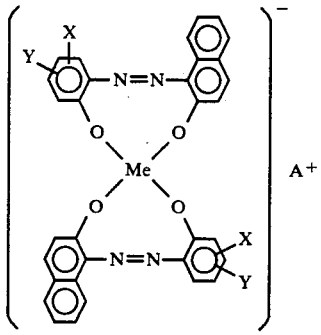

wherein at least one of X and Y represent(s) a hydrophilic group, and the other of X and Y represent(s) a hydrogen atom or an alkyl group having 1 to 10 carbon atoms; Me represents Cr, Ni, Co, Cu, Zn or Fe; and $A^+$ represents $H^+$, $K^+$, $Na^+$, $NH_4^+$ or $Li^+$ Formula (V)

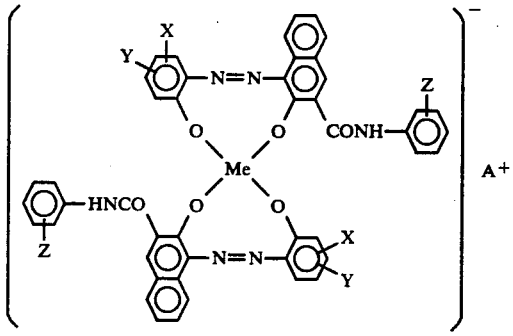

wherein at least one of X, Y and Z represent(s) a hydrophilic group, and any of the others of X, Y and Z represents a hydrogen atom or an alkyl group having 1 to 10 carbon atoms; Me represents Cr, Ni, Co, Cu, Zn or Fe; and $A^+$ represents $H^+$, $K^+$, $Na^+$, $NH_4^+$ or $Li^+$.

107. The apparatus according to claim 81, wherein said hydrophilic group is a group selected from the group consisting of $—SO_3H$, $—SO_3M$, —COOM, $—NR_3X$, —COOH, $—NH_2$, —CN, —OH, $—NHCONH_2$, —X, and $—NO_2$, wherein R represents an alkyl group, M represents an alkali metal or $—NH_4$, and X represents a halogen atom.

108. The apparatus according to claim 81, wherein said toner has a weight average particle diameter $D_4$ of 10 μm to 15 μm, a fine-powder content (particle diameter: 6.35 μm or smaller) of not more than 30% by number, a coarse-powder content (particle diameter: 20.2 μm or larger) of not more than 4% by weight, and an MI (melt index) value of not more than 10.

109. The apparatus according to claim 81, wherein said toner comprises a binder resin, magnetic particles and a charge control agent:

said binder resin having i) a polymerizable monomer unit contained in an amount of from 2 parts by weight to 30 parts by weight based a total weight of the resin, said monomer unit having an acid group comprised of a carboxyl group or an acid anhydride thereof, and ii) an acid value of from 1 to 70 as that of the resin as a whole;

said magnetic particles having a bulk density of not less than 0.35 g/cm$^3$; and said charge control agent comprises a metal complex salt monoazo dye having a hydrophilic group.

110. The apparatus according to claim 81, wherein said toner contains a cross-linked styrene copolymer.

111. The apparatus according to claim 109, wherein said binder resin contained a cross-linked styrene copolymer.

112. The apparatus according to claim 81, wherein said toner contains a weight average particle diameter $D_4$ of 5 μm to 15 μm.

113. The apparatus according to claim 81, wherein said toner contains a low-molecular weight polyalkylene.

114. The apparatus according to claim 113, wherein said toner shows two or more maximum values in a chromatogram in gel permeation chromatography.

115. The apparatus according to claim 81, wherein said developer comprises an insulative magnetic toner and a fine silica powder pretreated with a silicone oil.

116. The apparatus according to claim 81, wherein said developer comprises an insulative magnetic toner and a fine silica powder pretreated with a silane coupling agent and a silicone oil.

117. The apparatus according to claim 81, wherein said developer comprises an insulative magnetic toner and an alumina powder pretreated with a silicone oil.

118. The apparatus according to claim 81, wherein said developer-carrying member is equipped with a means for applying a bias.

119. The apparatus according to claim 81, wherein said electrostatic latent image bearing member has a digital latent image.

120. The apparatus according to claim 119, wherein said electrostatic latent image bearing member has an OPC photosensitive layer and a digital latent image formed by exposure to laser light.

121. The apparatus according to claim 25, wherein one of said a and b of Formula (II) is present.

122. The apparatus according to claim 25, wherein one of said a and b and one of said c and d of Formula (III) are present.

123. The apparatus unit according to claim 65, wherein one of said a and b of Formula (II) is present.

124. The apparatus unit according to claim 65, wherein one of said a and b and one of said c and d of Formula (III) are present.

125. The apparatus according to claim 105, wherein one of said a and b of Formula (II) is present.

126. The apparatus according to claim 105, wherein one of said a and b and one of said c and d of Formula (III) are present.

* * * * *

UNITED STATES PATENT AND TRADEMARK OFFICE

CERTIFICATE OF CORRECTION

PATENT NO. : 5,164,780

DATED : November 17, 1992

INVENTOR(S) : MANABU OHNO, ET AL.

It is certified that error appears in the above-identified patent and that said Letters Patent is hereby corrected as shown below:

COLUMN 2

Line 31, "When, a layer" should read --When a layer of--.

COLUMN 3

Line 51, "to" should read --to be--.

COLUMN 4

Line 6, "image:" should read --image;--.
Line 47, "which which carries" should read --which a developer--.

COLUMN 5

Line 55, "sleeve 2" should read --sleeve 2 are--.

COLUMN 13

Line 29, "dimetbylaminoethyl" should read --dimethylaminoethyl--.

COLUMN 14

Line 9, "trimethylolethone" should read --trimethylolethane--.
Line 10, "trimethylolpropan" should read --trimethylolpropane--.
Line 60, "2,2'-azcbisisobutyronitrile," should read --2,2'-azobisisobutyronitrile,--.

--

UNITED STATES PATENT AND TRADEMARK OFFICE

CERTIFICATE OF CORRECTION

PATENT NO. : 5,164,780

DATED : November 17, 1992

INVENTOR(S) : MANABU OHNO, ET AL.

It is certified that error appears in the above-identified patent and that said Letters Patent is hereby corrected as shown below:

COLUMN 16

Line 15, "cupper" should read --copper--.

COLUMN 17

Line 66, "power" should read --powder--.

COLUMN 19

Line 14, "nor" should read --not--.

COLUMN 20

Line 8, "ring" should read --ring.--. (2nd occurrence)

COLUMN 26

Line 19, "platen" should read --platen)--.
Line 40, "torotate." should read --to rotate.--.

COLUMN 28

Line 16, "dimeth one" should read --dimethylsilicone--.

COLUMN 36

Line 24, "0.8" should read --0.8.--.

COLUMN 39

Line 40, "18.5" should read --18.5.--.
Line 62, "subjecte" should read --subjected--.

--

UNITED STATES PATENT AND TRADEMARK OFFICE

CERTIFICATE OF CORRECTION

PATENT NO. : 5,164,780

DATED : November 17, 1992

INVENTOR(S) : MANABU OHNO, ET AL.

It is certified that error appears in the above-identified patent and that said Letters Patent is hereby corrected as shown below:

COLUMN 40

Line 35, "components." should read --components,--.
Line 57, "hexamethyldisiliazane" should read --hexamethyldisilazane--.

COLUMN 42

Line 37, "11.7 μm." should read --11.7 μm. ¶ Preparation Example 10--.

COLUMN 43

Line 1, "Then." should read --Then,--.
Line 42, "PET" should read --BET--.
Line 55, "replace" should read --replaced--.

COLUMN 44

Line 57, "image" should read --image.--.

COLUMN 48

Line 31, "agent:" should read --agent;--.

COLUMN 50

Line 48, "as that" should read --for--.
Line 49, "of" should be deleted.
Line 51, "a" (second occurrence) should read --an--.
Line 59, "contain" should read --contains--.

--

UNITED STATES PATENT AND TRADEMARK OFFICE

CERTIFICATE OF CORRECTION

PATENT NO. : 5,164,780

DATED : November 17, 1992

INVENTOR(S) : MANABU OHNO, ET AL.

It is certified that error appears in the above-identified patent and that said Letters Patent is hereby corrected as shown below:

COLUMN 54

Line 4, "claim 81" should read --claim 81,--.
Line 20, "claim 81" should read --claim 81,--.
Line 23, "claim 81" should read --claim,--.

COLUMN 56

Line 26, "type" should be deleted.

COLUMN 57

Line 21, "agent:" should read --agent;--.

Signed and Sealed this

Eleventh Day of January, 1994

Bruce Lehman

*Attest:*

BRUCE LEHMAN

*Attesting Officer*

*Commissioner of Patents and Trademarks*